US006619970B2

(12) United States Patent
Fukushima et al.

(10) Patent No.: US 6,619,970 B2
(45) Date of Patent: Sep. 16, 2003

(54) LEVER FITTING-TYPE MANUAL DISCONNECTOR

(75) Inventors: Hirotaka Fukushima, Shizuoka (JP); Satoru Ohshita, Shizuoka (JP); Yutaka Masuda, Shizuoka (JP); Hidehiko Kuboshima, Shizuoka (JP); Yasuyoshi Fukao, Aichi (JP); Shigemi Hashizawa, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/247,507

(22) Filed: Sep. 20, 2002

(65) Prior Publication Data

US 2003/0057958 A1 Mar. 27, 2003

(30) Foreign Application Priority Data

Sep. 25, 2001 (JP) ..... 2001-292242
Sep. 25, 2001 (JP) ..... 2001-292275

(51) Int. Cl.[7] ..... H01R 13/62

(52) U.S. Cl. ..... 439/157; 439/188; 439/180; 439/488; 439/489

(58) Field of Search ..... 439/157, 155, 439/159, 180, 488, 489, 347, 246, 247

(56) References Cited

U.S. PATENT DOCUMENTS 5,660,270 A * 8/1997 Martin et al.
5,928,014 A * 7/1999 Sawayanagi et al.
6,203,340 B1 * 3/2001 Yamashita et al.
2002/0016100 A1 * 2/2002 Okabe et al.
2002/0031928 A1 * 3/2002 Gundermann et al.
2002/0177338 A1 * 11/2002 Nishide et al.

FOREIGN PATENT DOCUMENTS

| | | |
|---|---|---|
| JP | 9-265874 | 10/1997 |
| JP | 10-144185 | 5/1998 |
| JP | 11-3743 | 1/1999 |
| JP | 2000-322983 | 11/2000 |
| JP | 2001-60429 | 3/2001 |

* cited by examiner

*Primary Examiner*—Dean A. Reichard
*Assistant Examiner*—Nguyen Ha
(74) *Attorney, Agent, or Firm*—Finnegan, Henderson, Farabow, Garrett, & Dunner, L.L.P.

(57) ABSTRACT

In a lever fitting-type manual disconnector 1A, first and second connector housing 1 and 3 are provided with terminals 9 and 35, respectively. A lever 2 is provided in rotatable and linearly movable manners on the first connector housing 1. A cam groove 21 is provided on the lever 2 and a cam pin 36 is provided on the second connector housing 3. When the lever 2 is rotated, the lever fitting-type manual disconnector 1A is set in a rotation completive position where the terminals 9 and 35 on the both connector housings 1 and 3 connect to one another. When the lever 2 is moved linearly from the rotation completive position, the lever fitting-type manual disconnector 1A is set in a fitting completive position where a fitting-state detective switch is turned on.

6 Claims, 31 Drawing Sheets

LEVER FITTING-TYPE MANUAL DISCONNECTOR

BACKGROUND OF THE INVENTION

1. Field of the Invention

The present invention relates to a lever fitting-type manual disconnector capable of fitting or detaching one connector housing into or out of the other connector housing by operating a lever with small control force using a cam mechanism.

2. Description of the Related Art

An electric car contains an electric power source, i.e. a battery, which has a larger capacity as compared to a battery in a usual gasoline-engine car or the like. Accordingly, in the event of maintenance of electric systems or the like, a power circuit is set open with a circuit breaker in order to secure operation safety. As illustrated in FIG. 1 to FIG. 4, Japanese Unexamined Patent Publication No. 9(1997)-265874 discloses such a related power circuit breaker.

As shown in FIG. 1 to FIG. 4, this circuit breaker 100 includes a body 101 and a detachable plug 102 disposed detachably on the body 101. The body 101 is provided with a pair of male terminals 103. One of the pair of male terminals 103 is electrically connected to a load, and the other male terminal 103 is electrically connected to a power unit via a fuse 104. A pair of perpendicular guide walls 106 each including a guide groove 105 are severally provided on outer positions of the pair of male terminals 103 of the body 101.

Moreover, as shown in FIG. 4, the body 101 is provided with a lead switch 107*a*. A closed state or an open state of the power circuit is detected by an on-state or an off-state of the lead switch 107*a*. Further, as shown in FIG. 1 and FIG. 4, the body 101 is provided with bolt fitting holes 108 in appropriate places. The body 101 is fixed to a fitting plane (not shown) with bolts (not shown) inserted into the bolt fitting holes 108.

The detachable plug 102 includes a control lever 110 provided with a pair of protrusions 109 on right and left side faces thereof, a plug body 112 fitted rotatably on the control lever 110 via shafts 111, and a pair of female terminals 114 fixed to the plug body 112 and electrically connected to each other with a bus bar 113. Moreover, magnets 107*b* are buried severally in right-and-left symmetric positions on the control lever 110.

When an operator grasps the control lever 110 of the detachable plug 102 and thereby inserts the pair of protrusions 109 into the pair of guide grooves 105 on the body 101 from the position illustrated with solid lines to the position illustrated with imaginary lines in FIG. 3, the male terminals 103 are inserted into the female terminals 114 owing to such an insertion stroke of the detachable plug 102. Due to this operation, as shown in FIG. 2, the pair of male terminals 103 are electrically connected to each other via the pair of female terminals 114 and the bus bar 113. Accordingly, the power circuit is set to a closed state. After the detachable plug 102 is inserted into the body 101, the control lever 110 is rotated with respect to the plug body 112 from the position illustrated with imaginary lines to the position illustrated with solid lines in FIG. 3, and the control lever 110 is thereby laid sideways on the body 101 as shown in FIG. 4. The magnet 107*b* closely faces the lead switch 107*a* immediately before laying the control lever 110 sideways, whereby the lead switch 107*a* is turned on. In this way, a closed state of the power circuit is detected electrically.

Meanwhile, in order to set this circuit to an open state, the control lever 110 laid sideways is rotated to an upright position, and the detachable plug 102 fitted to the body 101 is pulled upward from the body 101. In other words, an action reverse to the foregoing fitting action should be carried out. Then, the pair of female terminals 114 come out of the pair of male terminals 103 owing to a pulling stroke of the detachable plug 102, whereby the pair of male terminals 103 are disconnected from each other and the power circuit is set to the open state.

SUMMARY OF THE INVENTION

However, according to the related power circuit breaker 100, the power circuit is set to the closed state at the time of inserting the control lever 110 into the body 101 (in the state shown in FIG. 2). That is, although a fitting operation is completed only after the control lever 110 is laid sideways with respect to the body 101 as shown in FIG. 4, the power circuit is set to the closed state in the midst of the operation. Moreover, the lead switch 107*a* detects the closed state for the first time when the operation of the control lever 110 is completed. Therefore, there is a risk of misunderstanding that the power circuit still remains at the open state at the time of inserting the control lever 110 into the body 101, because the operation is not completed yet. Accordingly, it is preferable that the power circuit is set to the closed state for the first time after the operation of the control lever 110 is completed. Moreover, the power circuit is set to the open state at the time when the detachable plug 102 is pulled out of the body 101 and the pair of female terminals 114 are thereby disconnected from the pair of male terminals 103. Therefore, if the detachable plug 102 is pulled out in the state that a high voltage is applied to a load side, there is a risk of causing arc discharge.

Moreover, the above-described power circuit breaker 100 is designed such that the body 101 can be detached from the fitting plane by unfastening the bolts in the bolt inserting holes 108 of the body 101 even in the state where the control lever 110 is inserted into the body 101 and the male terminals 103 and the female terminals 114 are thereby connected to one another. Therefore, there is a problem that safety for an operator cannot be secured in the case of detaching the body 101 for the purpose of repairing or the like.

The present invention has been made in consideration of the foregoing problems. An object of the present invention is to provide a lever fitting-type manual disconnector capable of preventing a closed state of a power circuit prior to completion of an operation of a lever, and capable of surely preventing occurrence of arc discharge. In addition, another object of the present invention is to provide a lever fitting-type manual disconnector, in which fixing means thereof is detachable only in an open state upon detaching the other connector housing from a fitting plane for the purpose of repairing or the like, and thereby capable of surely securing safety for an operator.

A first aspect of the present invention is a lever fitting-type manual disconnector including a first connector housing having a first terminal, a second connector housing having a second terminal for being combined with the first connector housing, a lever provided on the first connector housing, a cam groove provided on the lever, a cam pin provided on the second connector housing for being engaged with the cam groove, and a fitting-state detective switch for detecting a fitting-state of the connector housings. Here, the lever is rotated while the cam pin is engaged with the cam groove to establish a rotation completive position, in which the terminals on the both connector housings contact to each other. Then, the lever is moved linearly from the foregoing position to establish a fitting completive position, in which the fitting-state detective switch is turned on. Further, the lever is moved linearly from the fitting completive position reverse to the foregoing linear direction to establish the rotation completive position, in which the fitting-state detective switch is turned off. Then, the lever is rotated from the rotation completive position reverse to the foregoing rotational direction to establish an unconnected state of the terminals by detaching the both connector housings. Moreover, a circuit to be turned on and off by the fitting-state detective switch, and a power switch composed of the respective terminals on the both connector housings are interposed in a power circuit in series connection.

According to the first aspect of the present invention, in this lever fitting-type manual disconnector, the terminals on the both connector housings are set to a connected state in the process of rotating the lever from a rotation initial position to the rotation completive position, whereby the power switch is turned on. However, the power circuit remains at the open state at this stage. The fitting-state detective switch is turned on in the process of moving the lever linearly from the rotation completive position to the fitting completive position, whereby the circuit is turned on and the power circuit is set to the closed state for the first time. Moreover, in the event of changing the power circuit from the closed state to the open state, the fitting-state detective switch is turned off in the process of moving the lever linearly from the fitting completive position to the rotation completive position. Accordingly, the circuit is turned off and the power circuit is thereby set to the open state, and the power switch composed of the terminals on the both connector housings is set to a detached state in the process of rotating the lever from the rotation completive position to the rotation initial position. Therefore, there is a time-lag between the time when the power circuit is turned off and the time when the power switch composed of the terminals is detached, whereby time for discharge is secured.

Meanwhile, a second aspect of the present invention is a lever fitting-type manual disconnector including terminals severally provided on first and second connector housings for being connected and unconnected by approaching and detaching movements, a lever provided movably on the first the connector housing, a cam groove provided on any one of the lever and the second connector housing, a cam pin provided on the other one of the lever and the second connector housing for being engaged with the cam groove. Here, when the lever is moved in a state that the cam pin is engaged with the cam groove, the first connector housing approaches the second connector housing owing to the cam pin being guided by the cam groove, and the terminals on the both connector housings contact to each other. Moreover, the movements of the lever includes a rotational movement between a rotation initial position and a rotation completive position where the terminals on the both connector housings are connected and unconnected, and a linear movement between the rotation completive position and a fitting completive position where a fitting-state detective switch is turned on and off. Furthermore, a relay circuit to be turned on and off by the fitting-state detective switch, and a power switch composed of the respective terminals on the both connector housings are interposed in a power circuit in series connection.

According to the second aspect of the present invention, in this lever fitting-type manual disconnector, the second connector housing is detachable only when the first connector housing is detached from the second connector housing or when the lever is set to the rotation initial position. In this way, safety for an operator is sufficiently secured in the case of detaching the second connector housing from a fitting plane for the purpose of repairing the breaker, which is designed to disconnect the power circuit by operating the lever in accordance with the rotational movement and the linear movement.

DESCRIPTION OF THE PREFERRED EMBODIMENTS

Now, embodiments of the present invention will be described with reference to the accompanying drawings.

Figure 1:
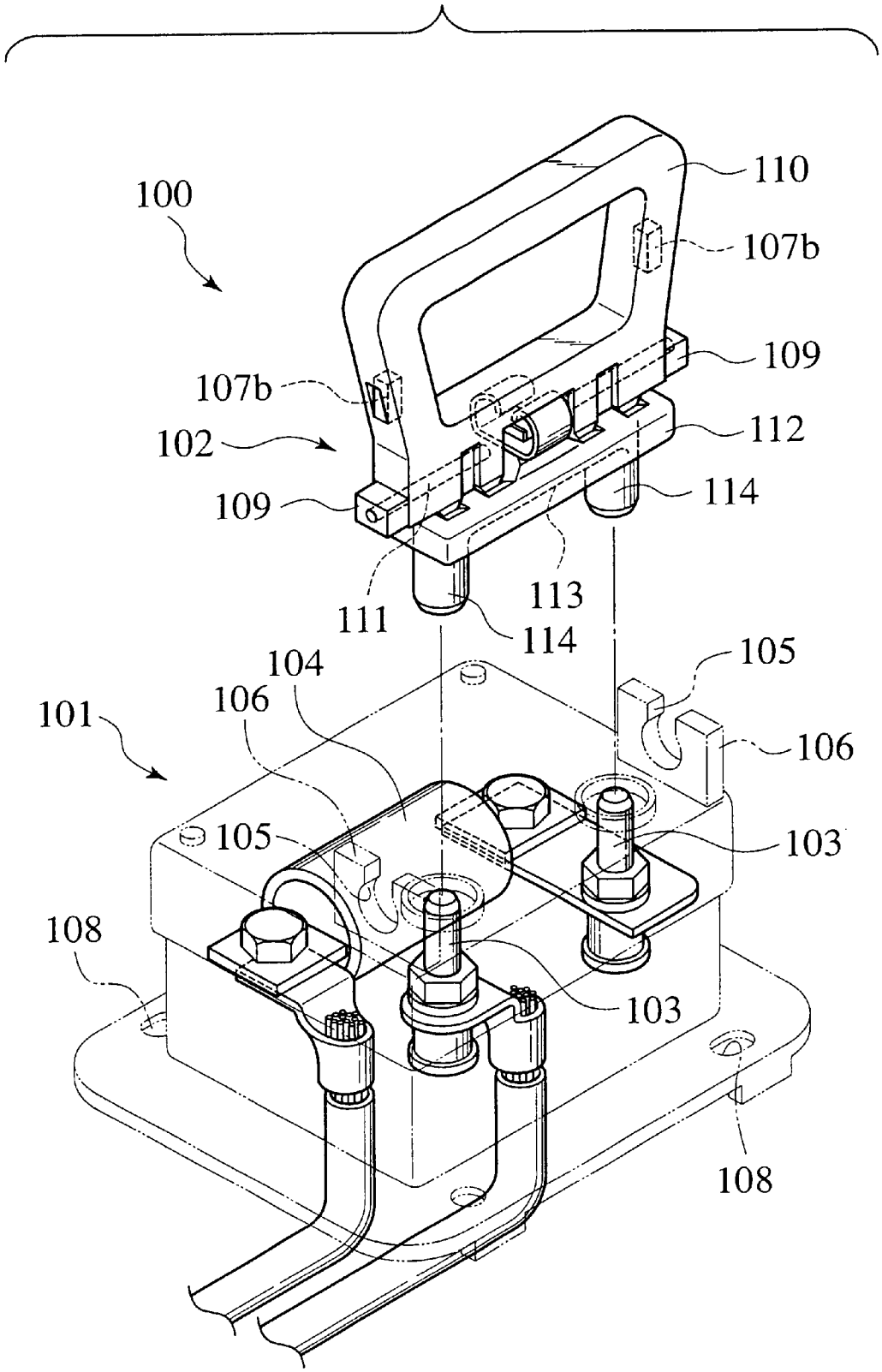
FIG. 1 is a perspective view of a related example showing a power circuit breaker prior to fitting.
Figure 2:
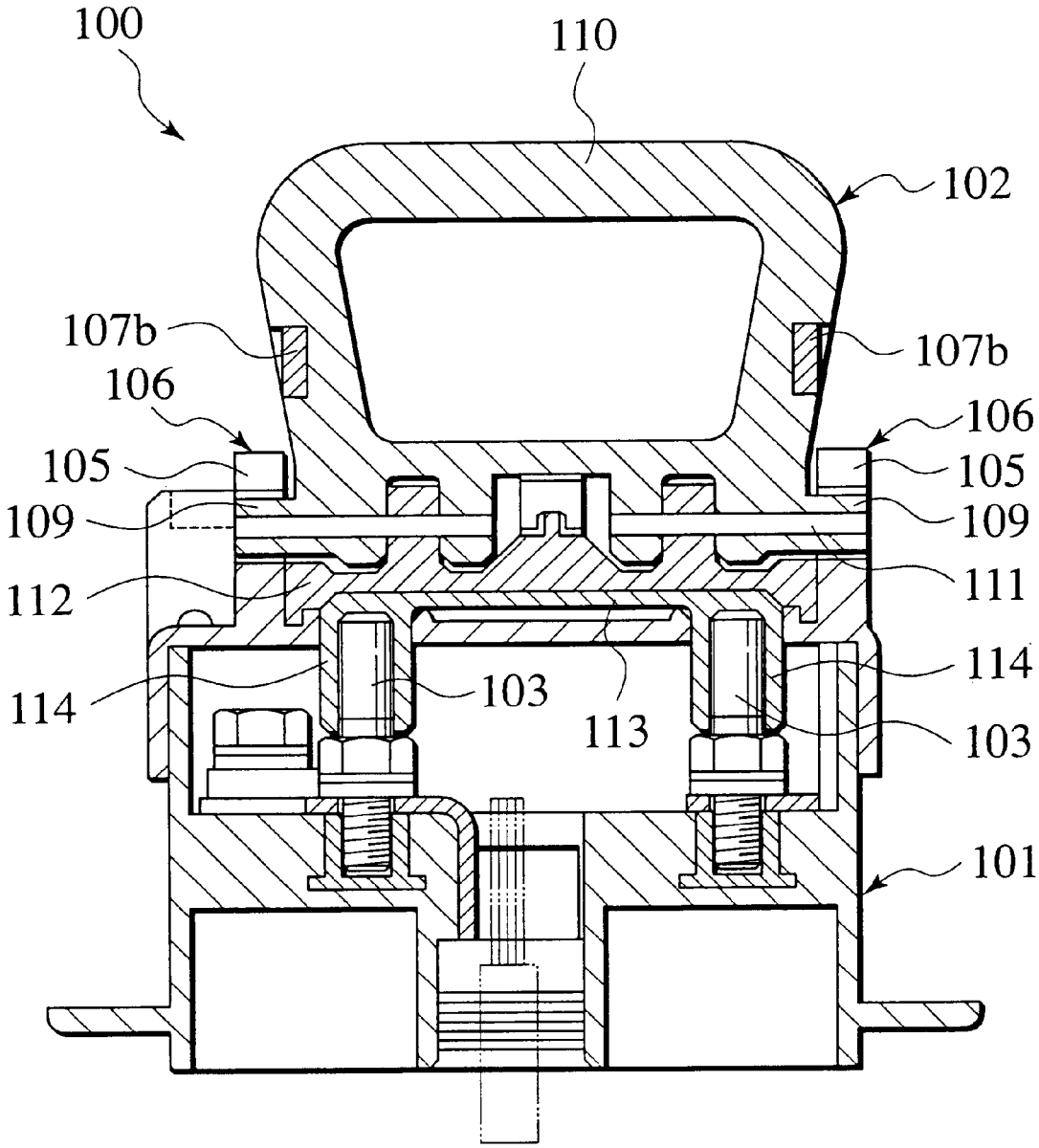
FIG. 2 is a cross-sectional view of the related example showing a state where a detachable plug is inserted into a body.
Figure 3:
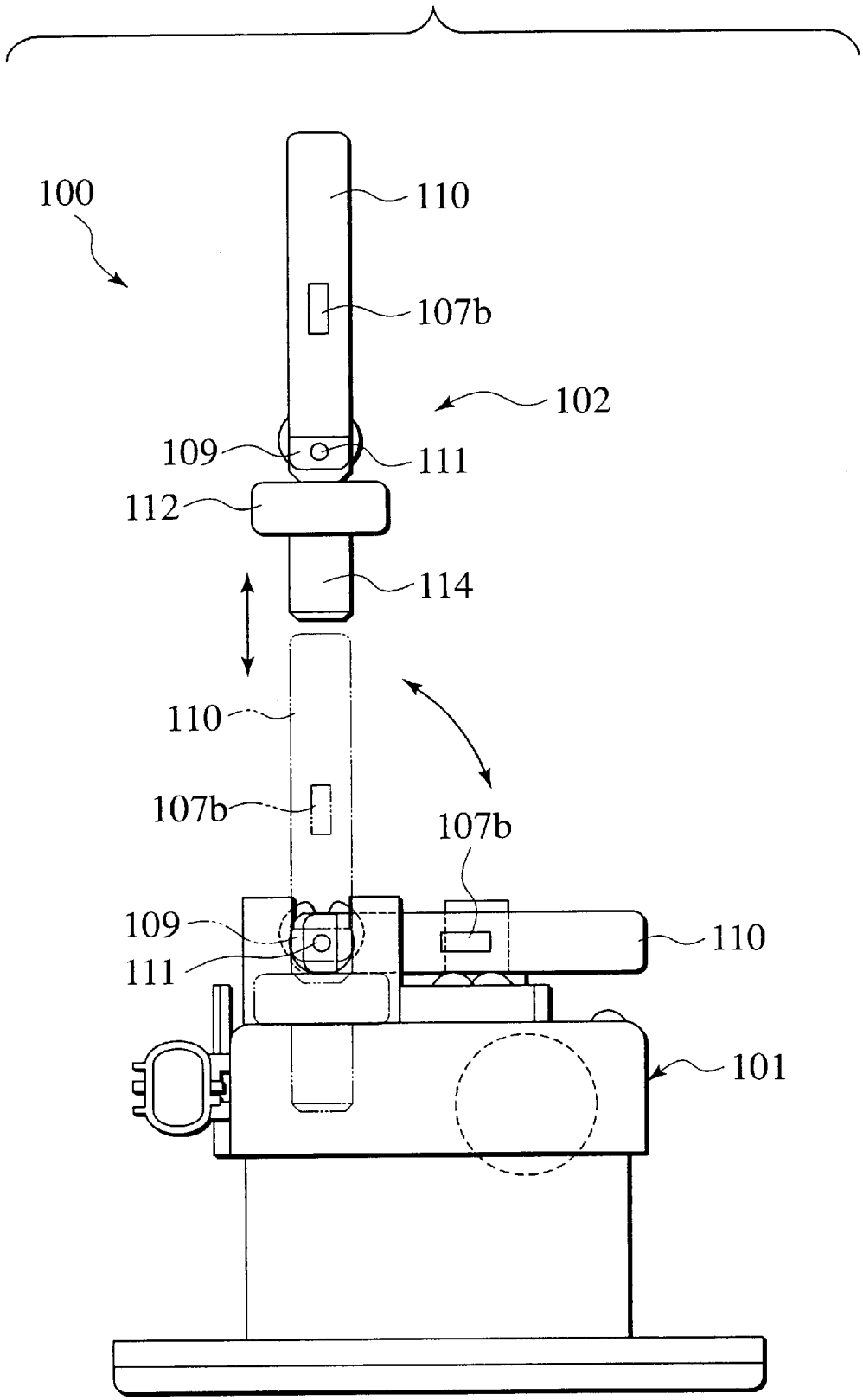
FIG. 3 is a side view of the related example showing a process of fitting the detachable plug into the body.
Figure 4:
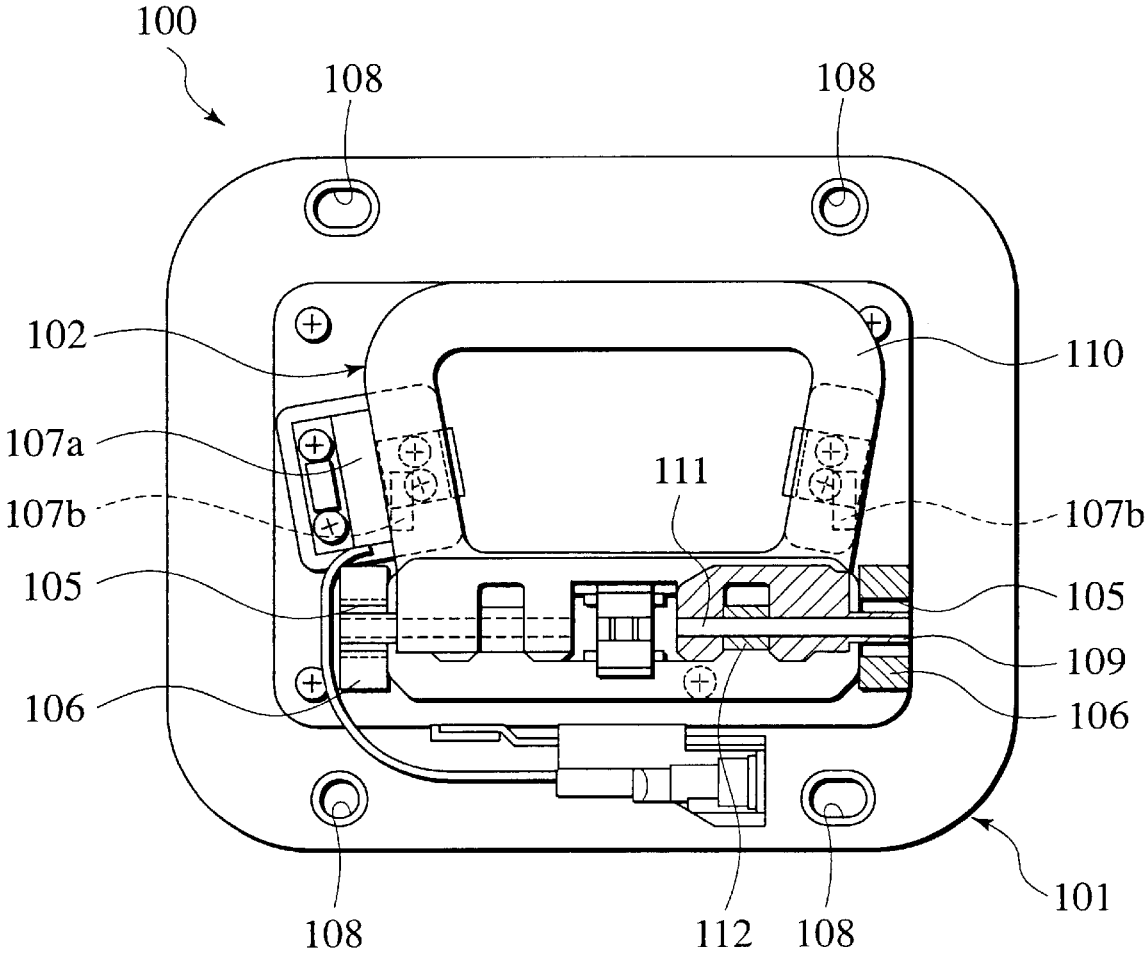
FIG. 4 is a plan view of the related example showing a state where detachable plug is fitted completely to the body.
Figure 5A:
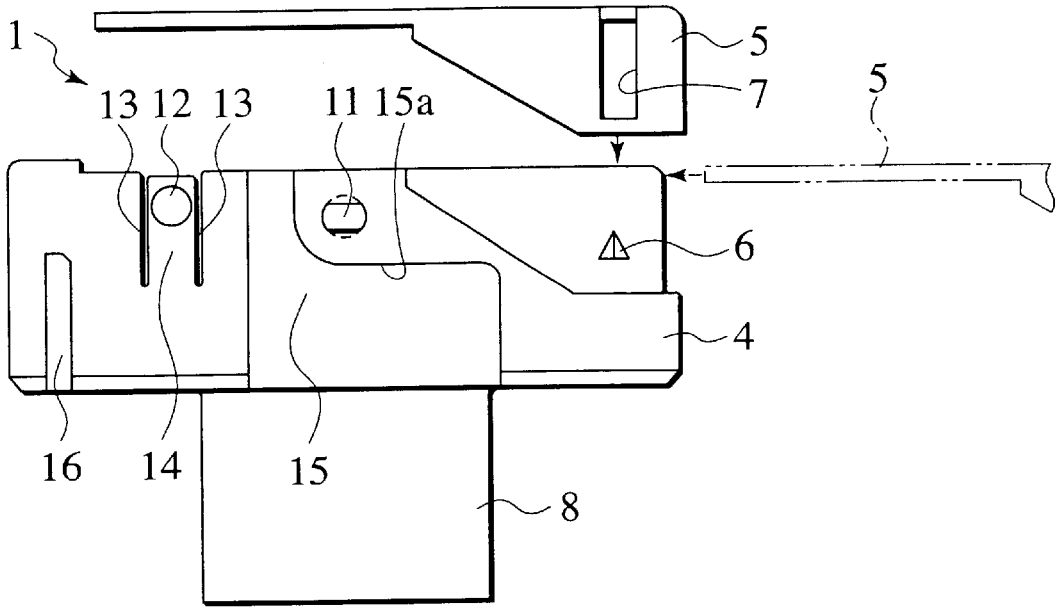
FIG. 5A is an exploded front view of a first connector housing according to a first embodiment of the present invention.
Figure 5B:
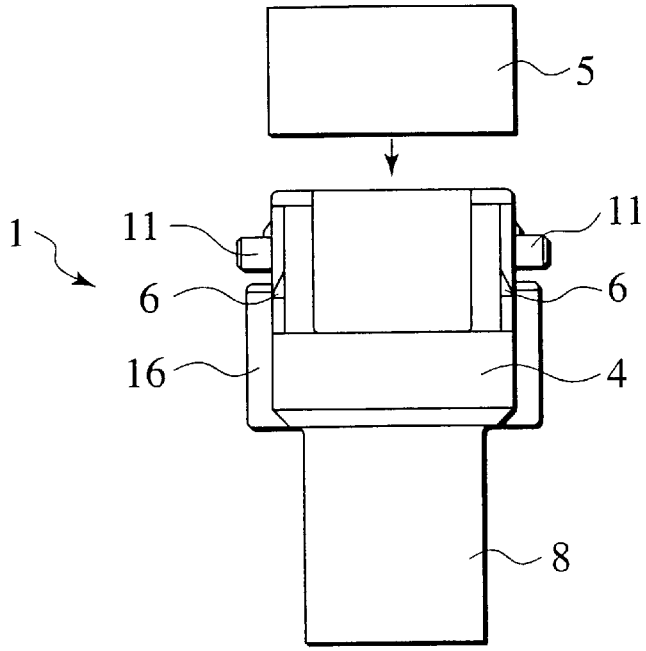
FIG. 5B is an exploded side view of the first connector housing according to the first embodiment of the present invention.
Figure 6:
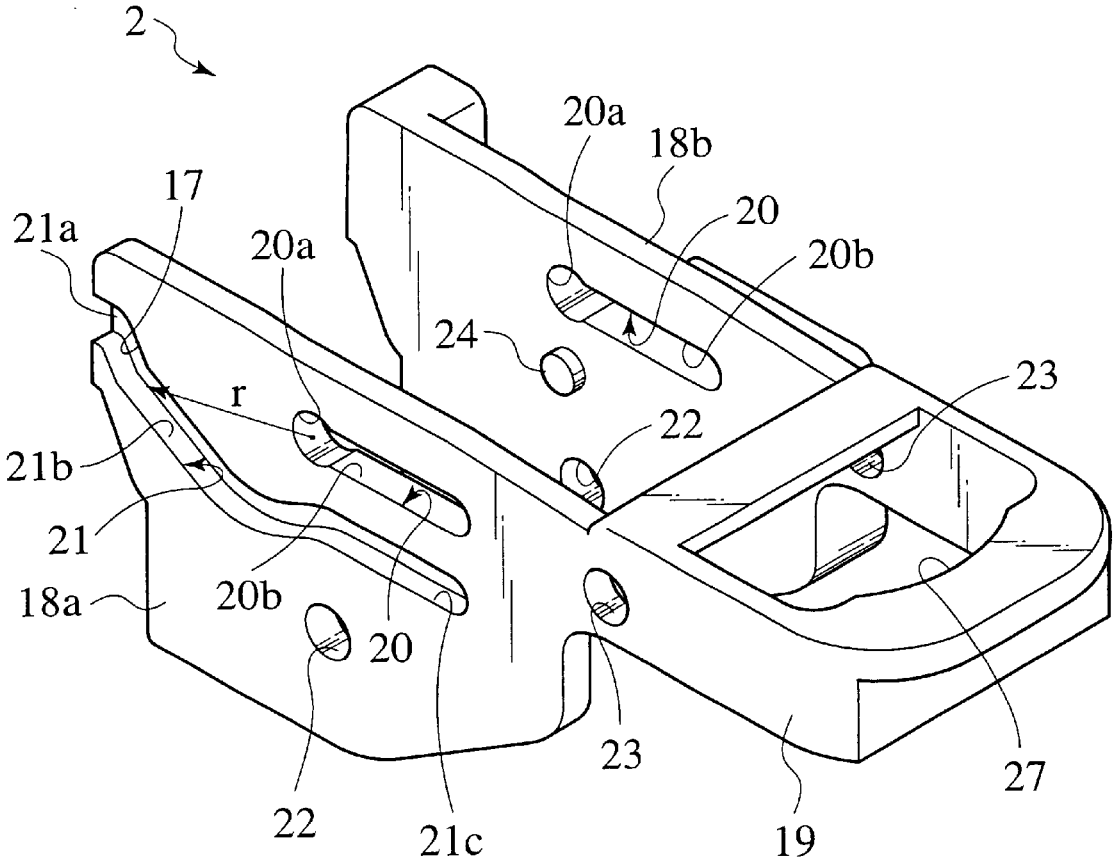
FIG. 6 is a perspective view of a lever according to the first embodiment of the present invention.
Figure 7A:
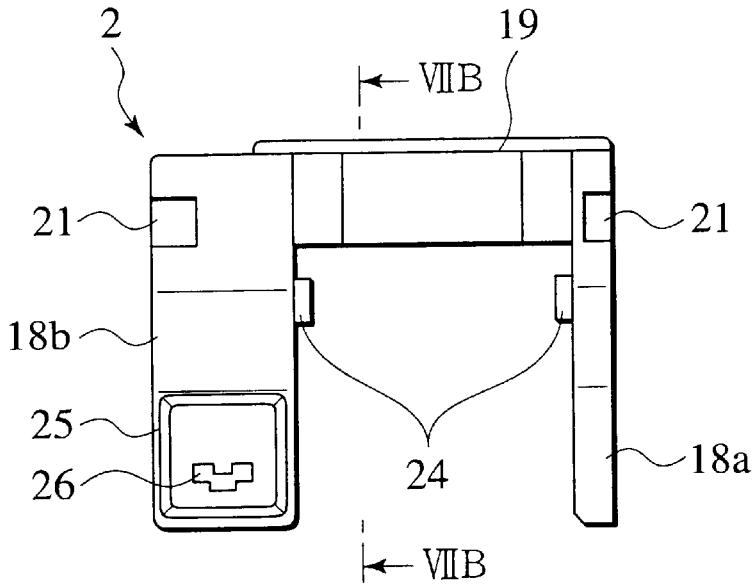
FIG. 7A is a side view of the lever according to the first embodiment of the present invention.
Figure 7B:
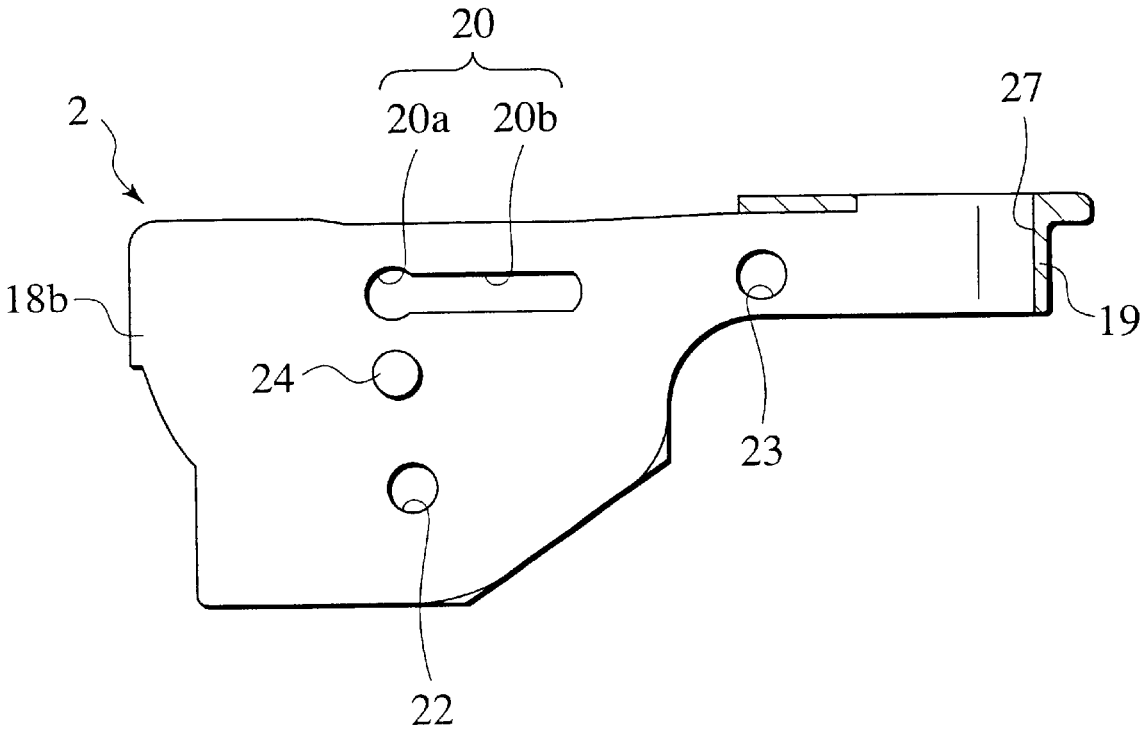
FIG. 7B is a cross-sectional view showing the first embodiment of the present invention, which is taken along the VIIB—VIIB line in FIG. 7A.
Figure 8:
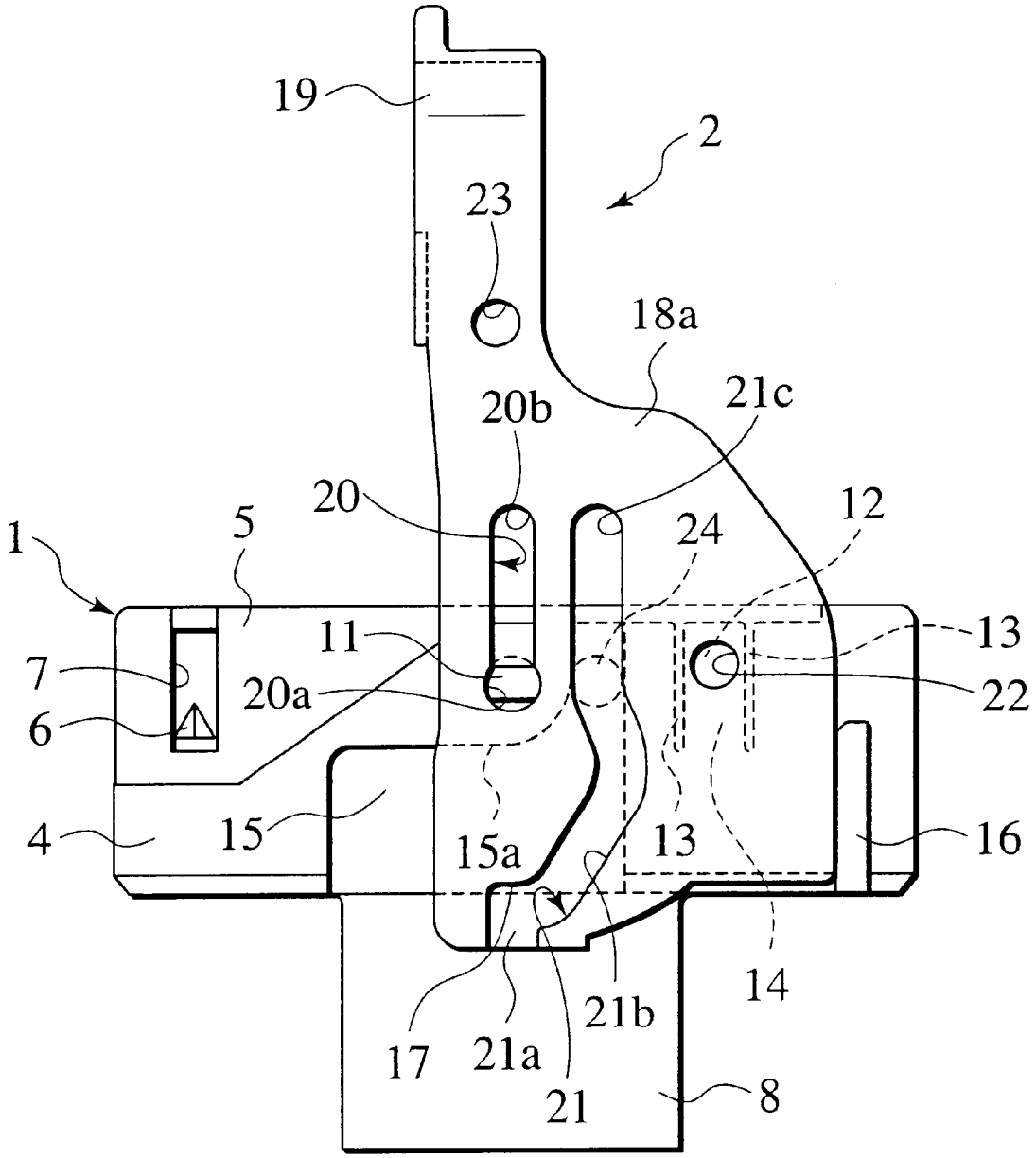
FIG. 8 is a front view showing the first connector housing fitted with the lever according to the first embodiment of the present invention, in a state where the lever is located at a rotation initial position.
Figure 9:
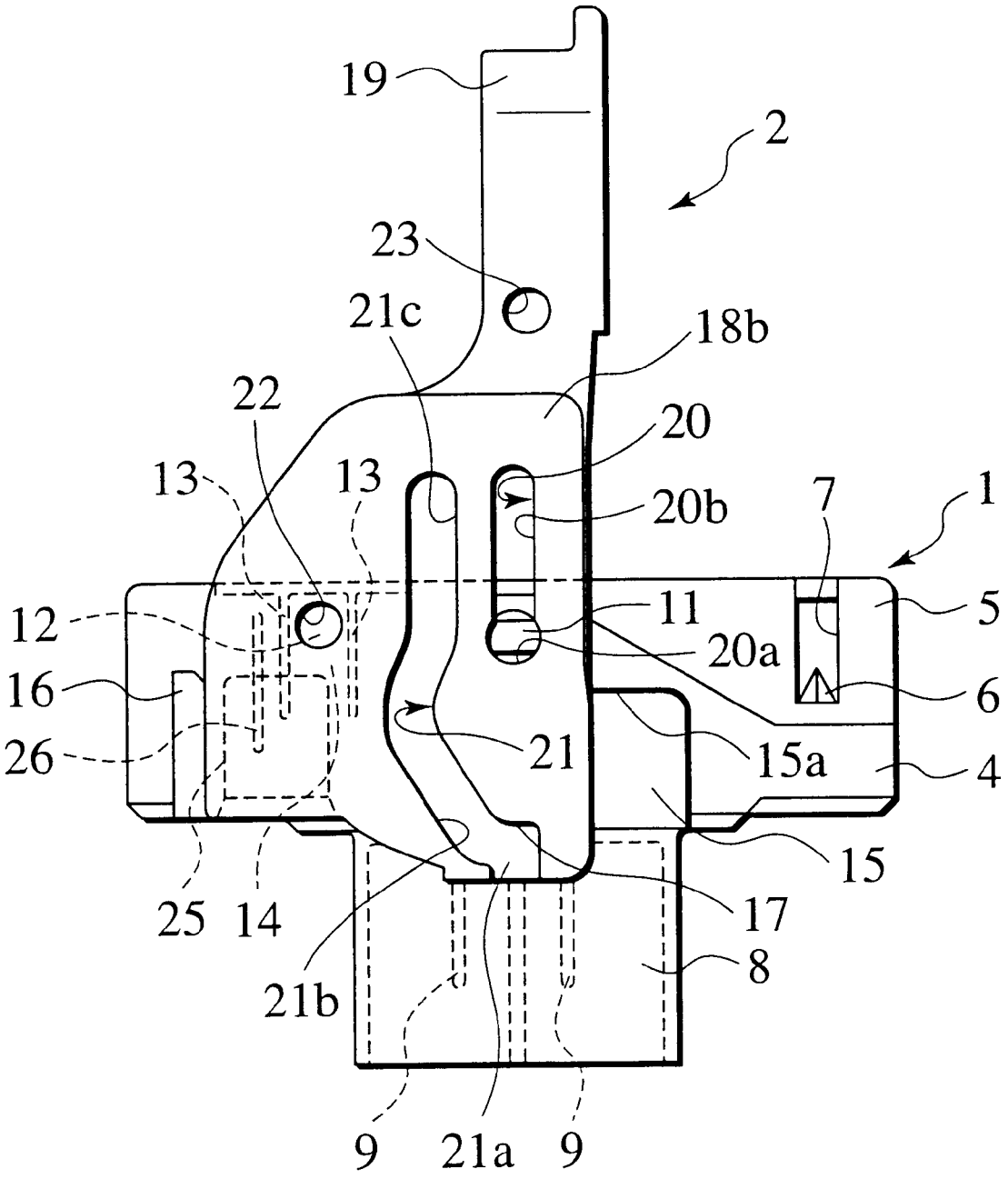
FIG. 9 is a rear view showing the first connector housing fitted with the lever according to the first embodiment of the present invention, in a state where the lever is located at a rotation initial position.
Figure 10A:
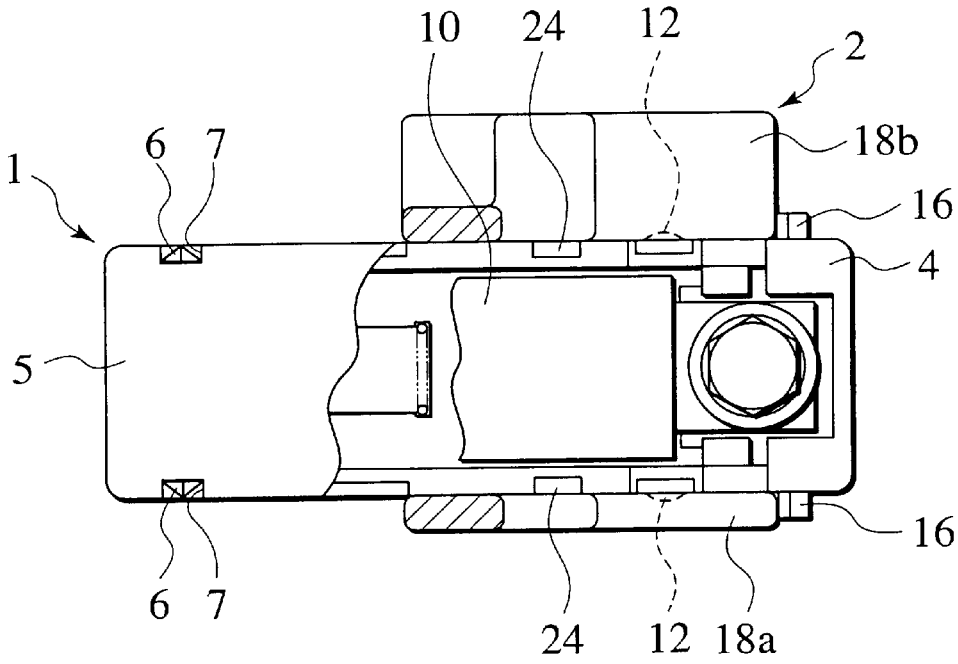
FIG. 10A is a partially cutaway plan view of the first connector housing fitted with the lever according to the first embodiment of the present invention.
Figure 10B:
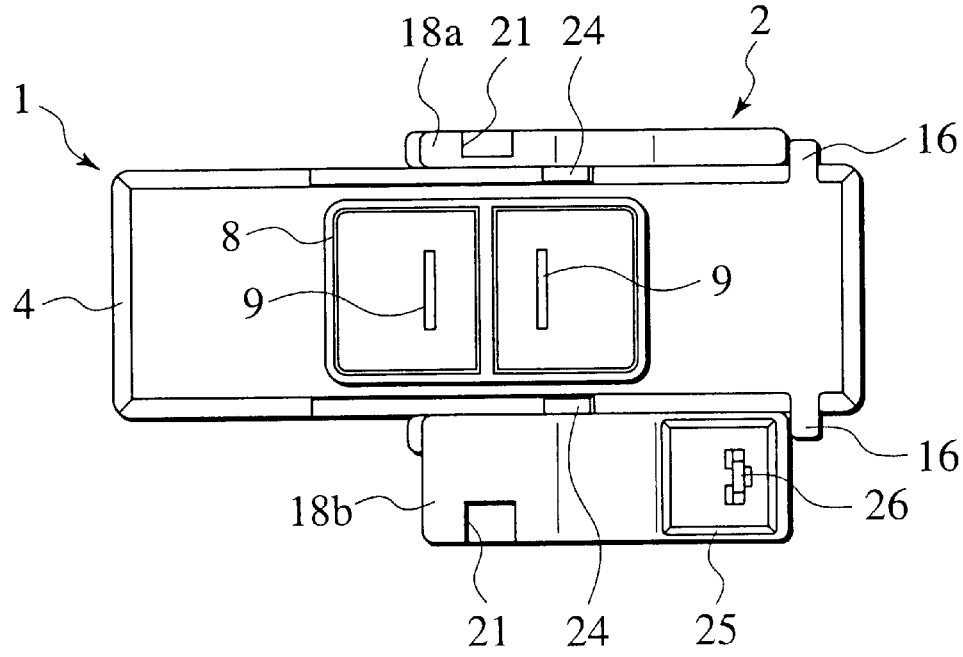
FIG. 10B is a bottom view of the first connector housing fitted with the lever according to the first embodiment of the present invention.
Figure 11:
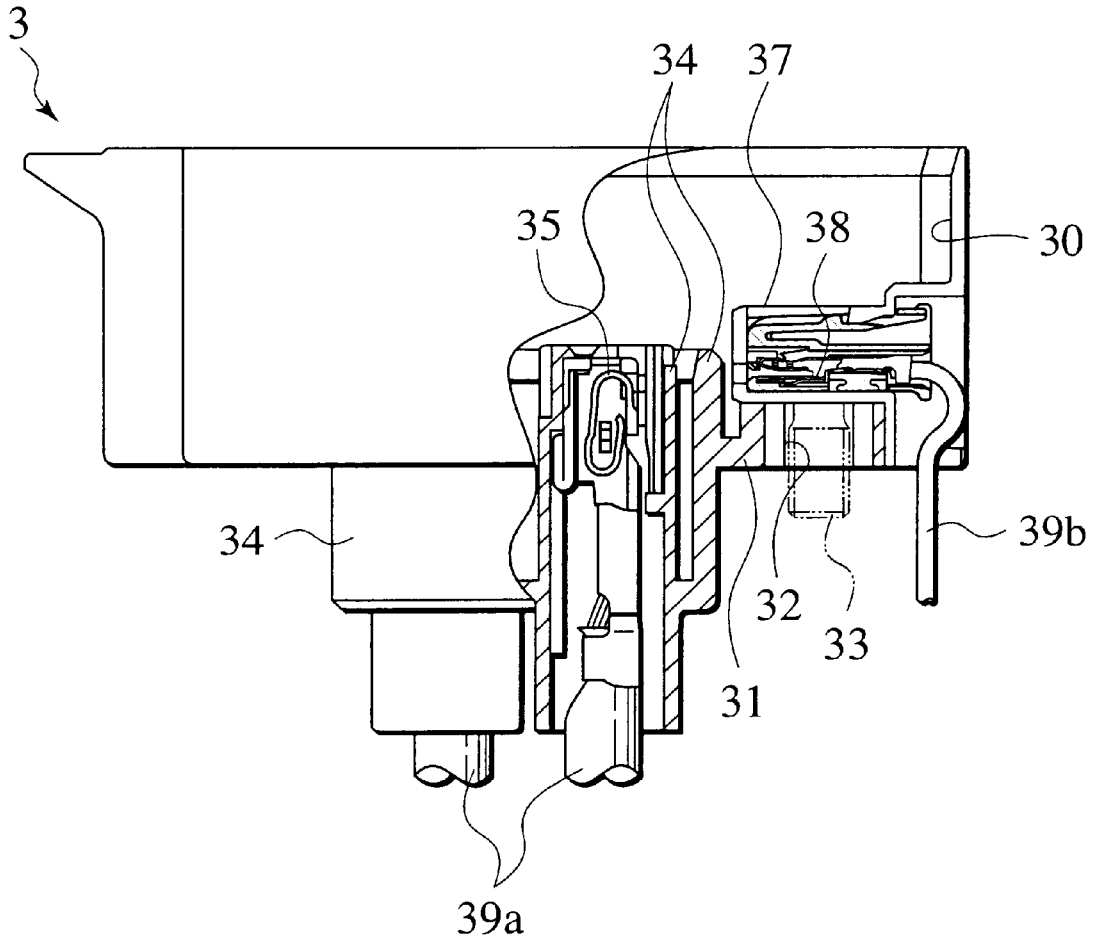
FIG. 11 is a partially cutaway plan view of a second connector housing according to the first embodiment of the present invention.
Figure 12A:
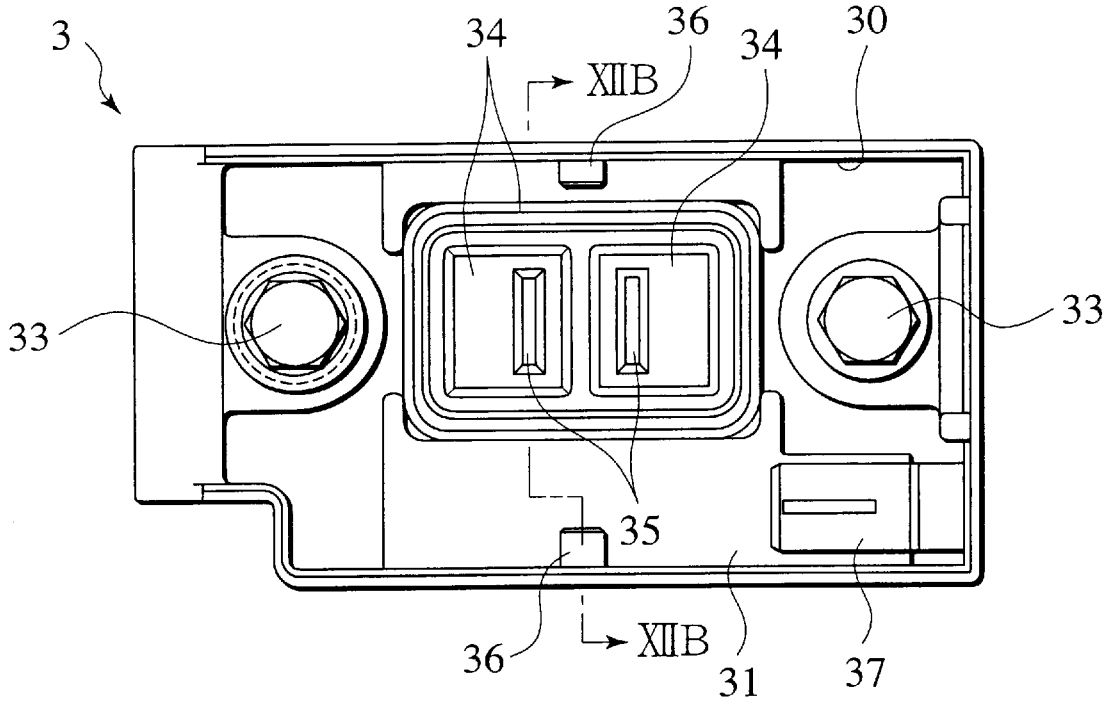
FIG. 12A is a plan view of the second connector housing according to the first embodiment of the present invention.
Figure 12B:
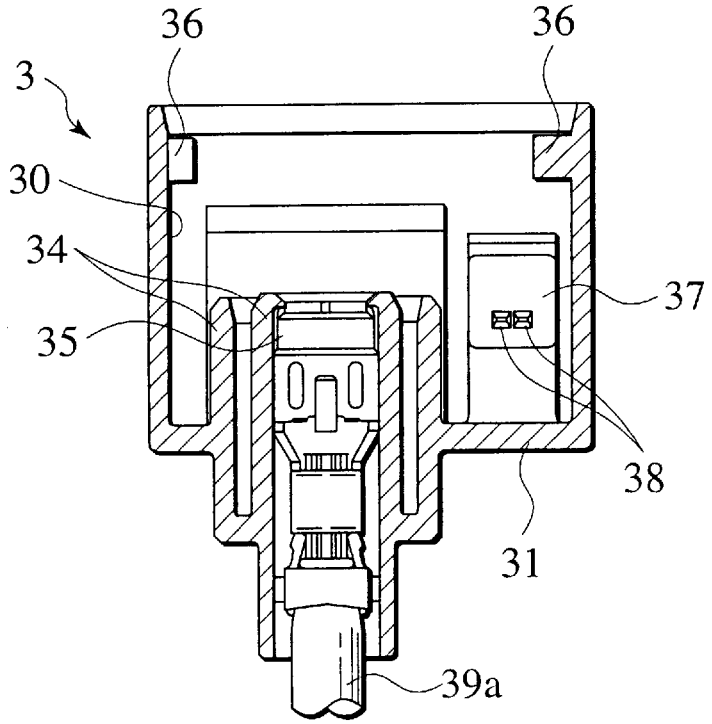
FIG. 12B is a cross-sectional view of the first embodiment of the present invention, which is taken along the XIIB—XIIB line in FIG. 12A.

FIG. 5A to FIG. 23B show a lever fitting-type manual disconnector for a high-voltage and large-current circuit according to a first embodiment of the present invention. FIG. 5A is an exploded front view of a first connector housing and FIG. 5B is an exploded side view of the first connector housing. FIG. 6 is a perspective view of a lever. FIG. 7A is a side view of the lever and FIG. 7B is a cross-sectional view taken along the VIIB—VIIB line in FIG. 7A. FIG. 8 is a front view of the first connector housing fitted with the lever in the state where the lever is located at a rotation initial position. FIG. 9 is a bottom view of the first connector housing fitted with the lever in the state where the lever is located at the rotation initial position. FIG. 10A is a partially cutaway plan view of the first connector housing fitted with the lever, and FIG. 10B is a bottom view of the first connector housing fitted with the lever. FIG. 11 is a partially cutaway front view of a second connector housing. FIG. 12A is a plan view of the second connector housing, and FIG. 12B is a cross-sectional view taken along the XIIB—XIIB line in FIG. 12A.

As shown in FIG. 14 to FIG. 16 and FIG. 19A to FIG. 23B, a lever fitting-type manual disconnector 1A for a high-voltage and large-current circuit includes a first connector housing 1 made of plastics, a lever 2 made of plastics which is fitted to the first connector housing 1, and a second connector housing 3 made of plastics to which the first connector housing 1 is fitted by an operation with the lever 2.

As shown in FIG. 5A and FIG. 9 to FIG. 10B, the first connector housing 1 includes a housing body 4 and a cover 5 to be fitted so as to occlude an upper portion of the housing body 4. Further, the housing body 4 includes a pair of triangular pyramid protrusions (convex portions) 6. The cover 5 is designed to be fitted to the housing body 4 by inserting the protrusions 6 into retaining holes 7 on the cover 5. Each of the respective protrusions 6 of triangular pyramid shapes is provided such that a lower portion side thereof in FIG. 5A constitutes a perpendicular plane with respect to a side face of the housing body 4, and that an upper portion and side portions thereof constitute inclined planes which stand up gradually from a plane of the housing body 4. In this way, the cover 5 can be fitted from both directions of a direction from the upper portion of the housing body 4 as illustrated with solid lines in FIG. 5A and a direction from the side portion of the housing body 4 as illustrated with imaginary lines in FIG. 5A. Therefore, the cover 5 is designed as easily fittable or detachable in the case of disposing the lever fitting-type manual disconnector 1A in a small space.

Figure 22:
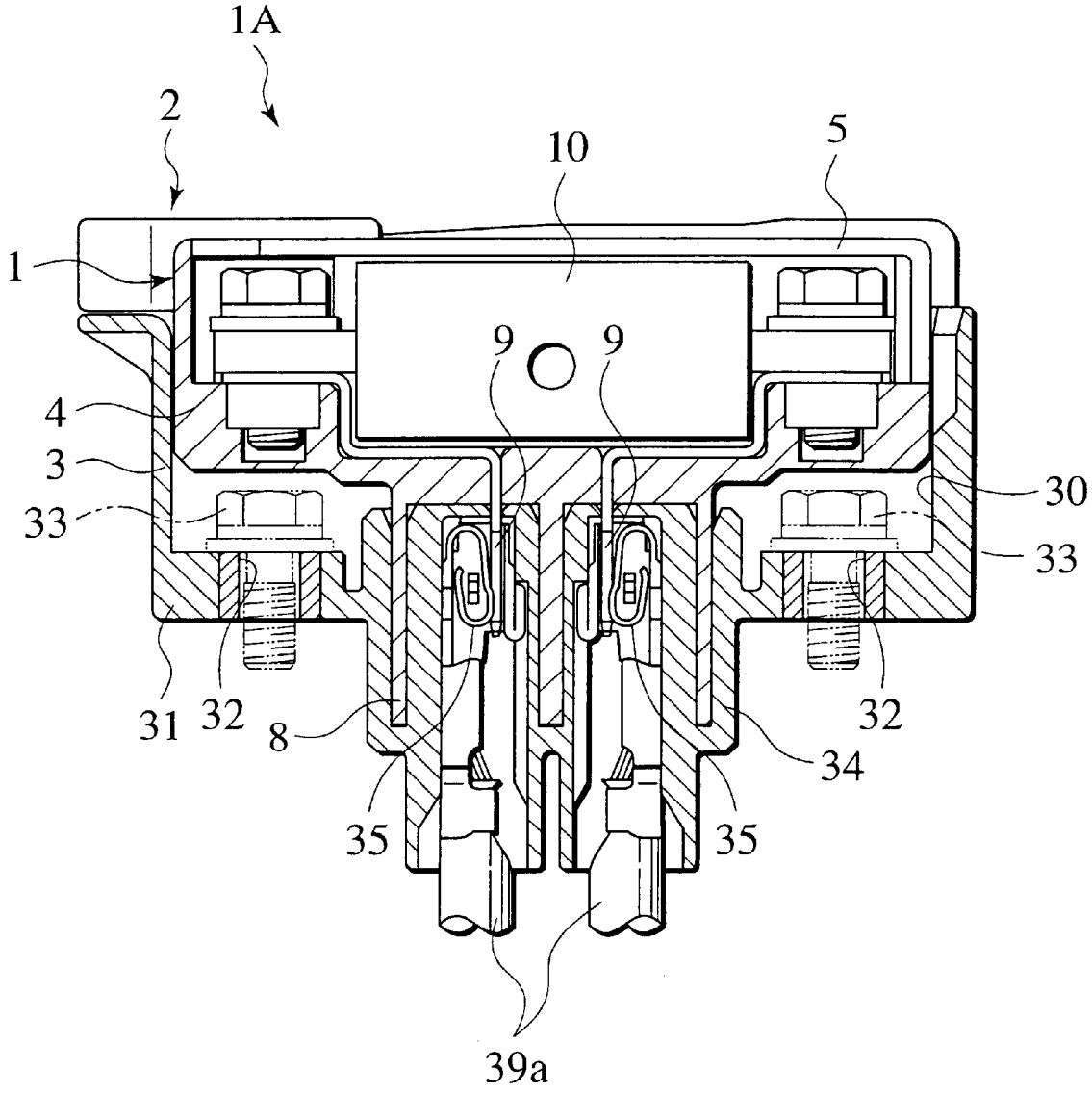
FIG. 22 is a cross-sectional view of the first embodiment of the present invention, which is taken along the XXII—XXII line in FIG. 19A.

A terminal hood 8 is provided on the lower portion of the housing body 4. Inside the terminal hood 8 provided are a pair of male terminals 9 as shown in FIG. 9 and FIG. 10B in a protruding manner toward a direction to be fitted into female terminals to be described later. The pair of male terminals 9 are connected electrically to each other via a fuse 10, which is housed inside the housing body 4 as shown in FIG. 10A and FIG. 22.

A pair of guide pins 11 are provided in a protruding manner on outer walls of the housing body 4. Each of the guide pins 11 has an approximately oval shape in which upper and lower ends of a columnar shape are cut away. In other words, the guide pin 11 includes a long width portion and a short width portion. Moreover, the pair of guide pins 11 are severally engaged with guide grooves 20 on the lever 2 to be described later.

Moreover, a pair of retaining protrusions (convex portions) 12 of an approximately semispherical shape are provided in a protruding manner on the outer wall of the housing body 4. Each of the pair of retaining protrusions 12 is provided on a flexible arm 14 formed between a pair of slits 13 on the outer wall of the housing body 4. The pair of retaining protrusions 12 are provided for retaining the lever 2 in a predetermined position by being inserted into either first retaining holes 22 or second retaining holes 23 of the lever 2 to be described later. Furthermore, the retaining protrusion 12 is designed as easily displaceable in an inward direction of the housing body 4 owing to elastic flexure deformation of the flexible arm 14. In addition, a pair of lever track corrective guide grooves 15 are provided on the outer walls of the housing body 4. A stepped side face 15*a*, which constitutes each lever track corrective guide groove 15, includes a perpendicular step side face extending in a up-and-down direction, a horizontal step side face extending in a horizontal direction, and an arc step side face connecting the foregoing two side faces together with an arc. Moreover, a pair of lever track corrective guide pins 24 on the after-mentioned second connector housing 3 are engaged with the pair of lever track corrective guide grooves 15. The pair of the lever track corrective guide pins 24 are designed to slide along the stepped side faces 15*a* of the lever track corrective guide grooves 15.

Moreover, a pair of lever rotation stoppers 16 are provided on the housing body 4 in a protruding manner. The pair of lever rotation stoppers 16 control rotation of the lever 2 such that the lever 2 is rotatable only between a rotation initial position shown in FIG. 14 where the lever 2 is set upright with respect to the first connector housing 1, and a rotation completive position where the lever 2 is set parallel to the first connector housing 1.

Figure 15:
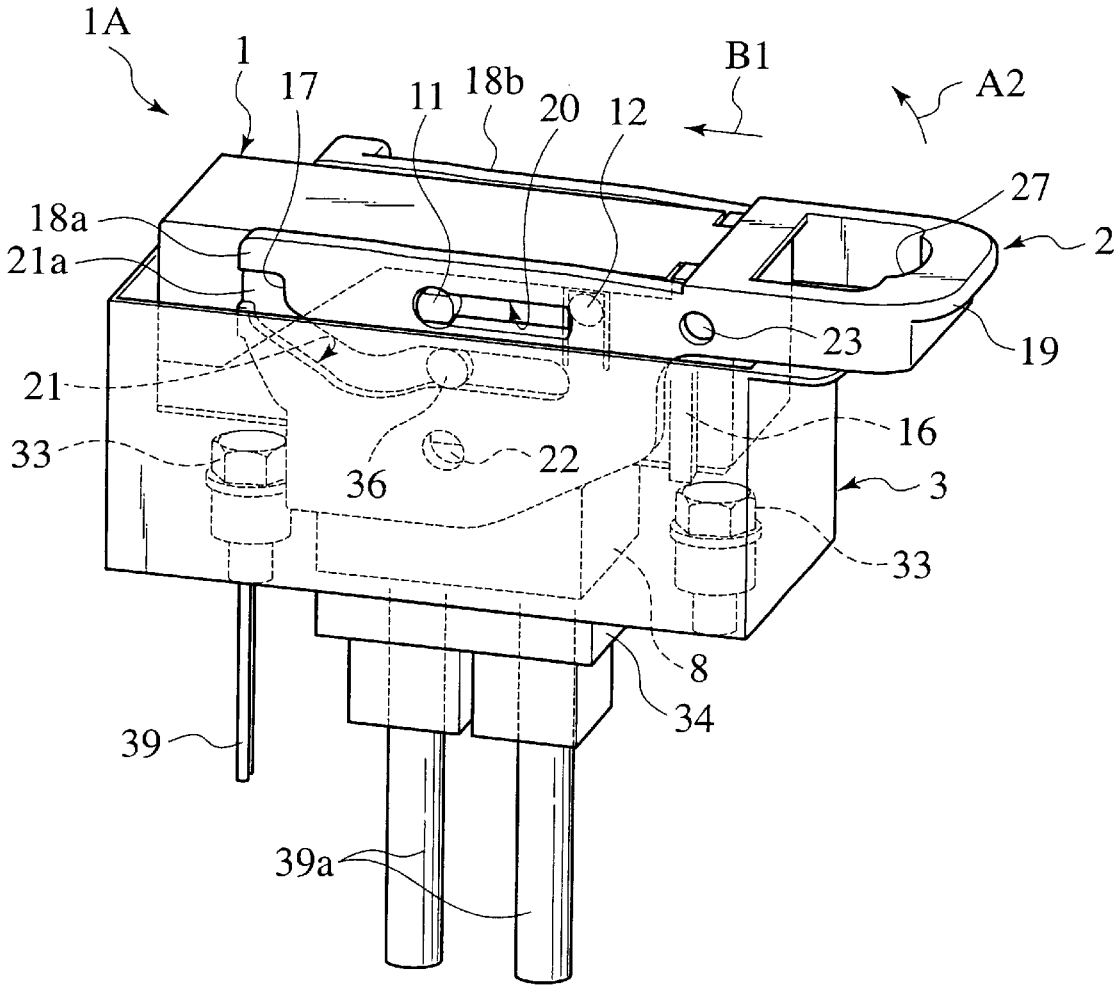
FIG. 15 is a perspective view of the first embodiment of the present invention, showing a state in the process of fitting the first connector housing to the second connector housing, in which the lever is located at a rotation completive position.
Figure 16:
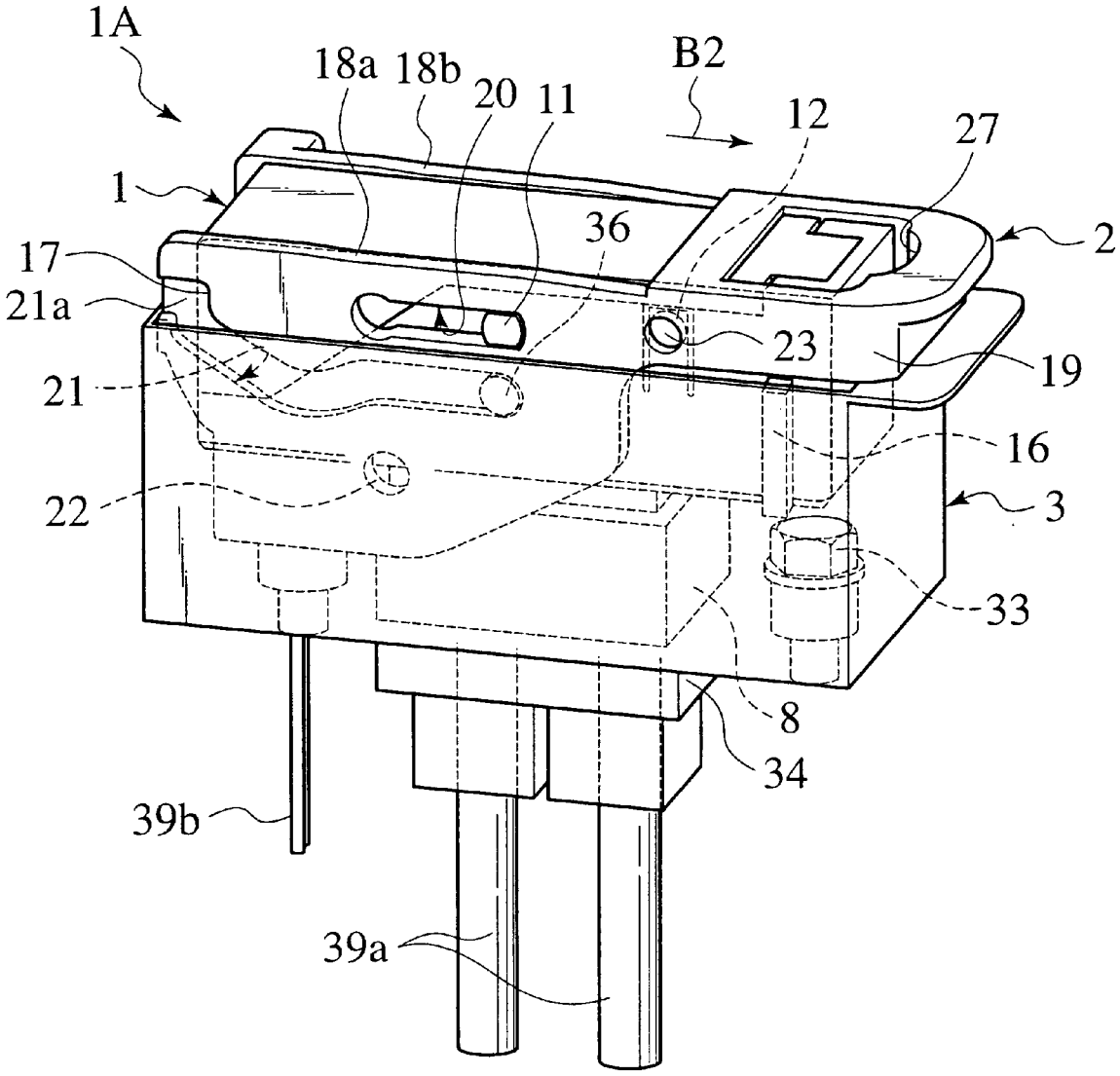
FIG. 16 is a perspective view of the first embodiment of the present invention, showing a state where the first connector housing is fitted completely to the second connector housing.

As shown in FIG. 6 to FIG. 10B, the lever 2 includes a pair of arm plates 18*a* and 18*b* disposed parallel to each other with provision of a space, and an operating portion 19 for mutually joining the pair of arm plates 18*a* and 18*b*. The guide grooves 20 extending in a horizontal direction are provided in symmetric positions on the pair of arm plates 18*a* and 18*b*, and the pair of guide pins 11 on the connector housing 1 are inserted severally into the guide grooves 20. Each of the guide grooves 20 includes an arc portion 20*a* on one end and a straight portion 20*b* to be linked therewith. A diameter of the arc portion 20*a* is made slightly larger than a diameter of an arc portion (the long width portion) of the guide pin 11, and a width of the straight portion 20*b* is made slightly larger than a width of a cutaway portion (the short width portion) of the guide pin 11. Moreover, regarding the lever 2, the guide pin 11 can be disposed only on the arc portion 20*a* of the guide groove 20 in a rotational position other than the rotation completive position as shown in FIG. 15, whereby a rotational movement between the rotation initial position of FIG. 14 and the rotation completive position of FIG. 15 is permitted. Furthermore, regarding the lever 2, the guide pin 11 is made slidable from the arc portion 20*a* of the guide groove 20 toward the straight portion 20*b* at a rotational position of the rotation completive position shown in FIG. 15 (or a fitting completive position shown in FIG. 16), whereby a linear movement by sliding between the rotation completive position of FIG. 15 and the fitting completive position of FIG. 16 is permitted. As described above, the lever 2 is provided as rotatable and linearly movable with respect to the first connector housing 1.

Meanwhile, cam grooves 21 are provided in symmetric positions of the pair of arm plates 18*a* and 18*b*. The after-mentioned cam pins 36 of the second connector housing 3 are inserted into the pair of cam grooves 21 upon fitting the first connector housing 1 to the second connector housing 3. Each of the cam grooves 21 includes an aperture 21*a* on one end which is opened at an end face of the arm plate 18*a* or 18*b*, a bent portion 21*b* of which a distance r from the arc portion 20*a* of the guide groove 20 varies in a gradually approaching manner in accordance with a direction from the aperture 21*a* toward the operating portion 19, and a straight portion 21*c* disposed parallel to the straight portion 20*b* of the guide groove 20.

Figure 14:
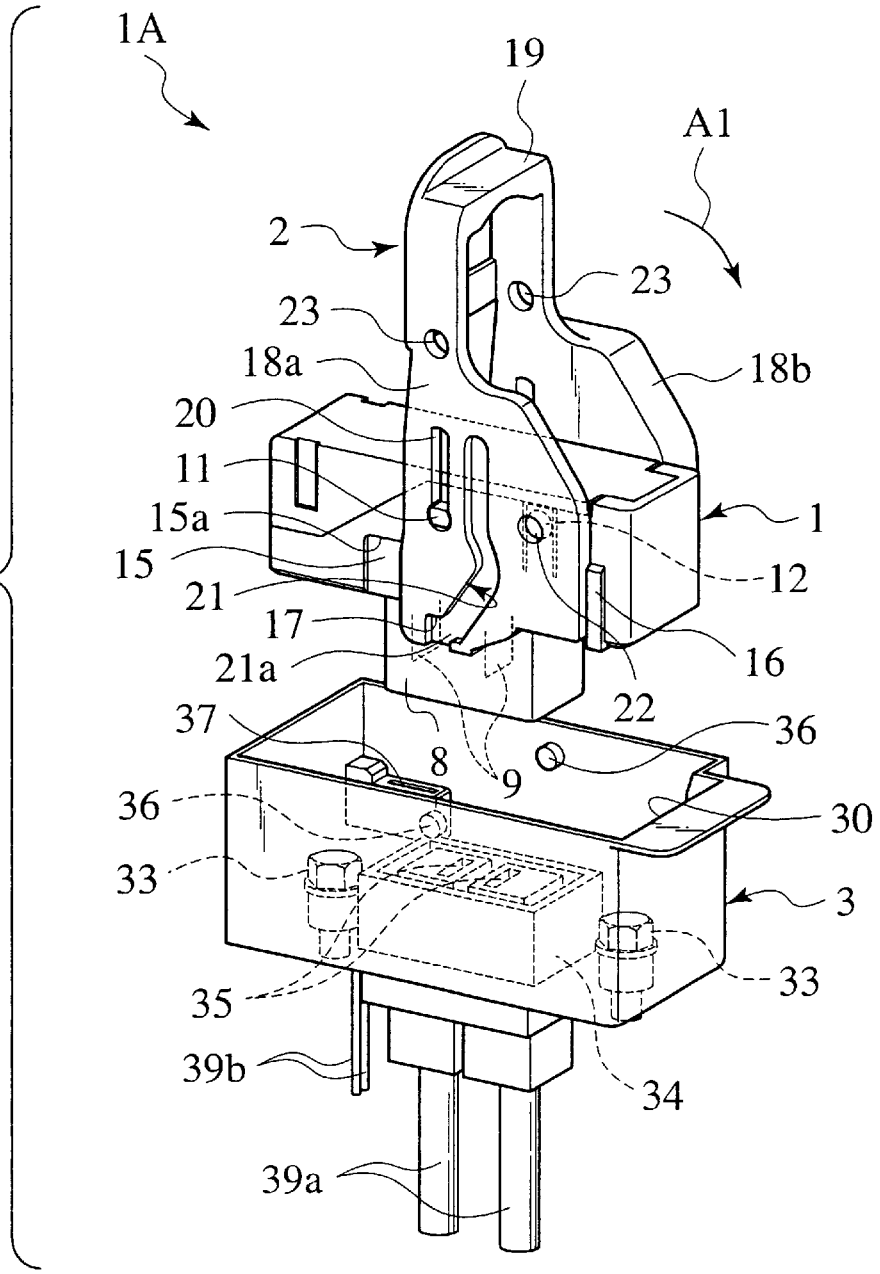
FIG. 14 is a perspective view of the first embodiment of the present invention, showing a state prior to fitting of the first connector housing on the second connector housing.

Furthermore, as shown in FIG. 14, an upper sidewall face of the aperture 21*a* in a state of setting the lever 2 upright is formed as a sidewall stopper face 17 for allowing the cam groove 21 to abut on the cam pin 36 in the event of inserting the first connector housing 1 into the second connector housing 3 without using the lever 2 in order to constitute a tentative fitting position. In other words, insertion of the cam pin 36 is inhibited by the sidewall face, and further insertion is conducted only by operating the lever 2. Accordingly, there is no risk of fitting the first connector housing 1 improperly on the second connector housing 3.

Moreover, first retaining holes (concave portions) 22 and second retaining holes (concave portions) 23 are provided severally in symmetric positions on the pair of arm plates 18*a* and 18*b*. The retaining protrusions 12 on the first connector housing 1 are inserted into the first retaining holes 22 and the second retaining holes 23. In the rotation initial position where the lever 2 is set upright with respect to the first connector housing 1, the retaining protrusions 12 are inserted into the first retaining holes 22 and the lever 2 is thereby retained in the rotation initial position. Further, in the fitting completive position where the lever 2 is set parallel to the first connector housing 1, the retaining protrusions 12 are inserted into the second retaining holes 23 and the lever 2 is thereby retained in the fitting completive position. Since the rotation completive position of the lever 2 is an intermediate operational position, the retaining protrusions 12 are not retained.

Furthermore, the pair of lever track corrective guide pins 24 are provided severally on inner walls of the pair of arm plates 18*a* and 18*b*. The pair of lever track corrective guide pins 24 are retained in the pair of lever track corrective guide grooves 15 on the first connector housing 1. Moreover, one of the pair of arm plates 18*a* and 18*b* is made wider than the other, and a connector unit 25 is provided on the wider arm plate 18*b* as shown in FIG. 7A and FIG. 9. This connector unit 25 is provided with fitting-state detective male terminals 26 as fitting-state detective terminals. Furthermore, the operating portion 19 is provided with a finger inserting hole 27. This finger inserting hole 27 is set to a size so that just one human finger can be barely inserted therein.

As shown in FIG. 11 to FIG. 12B, the second connector housing 3 has an approximately rectangular parallelepipedic shape with opening on an upper face thereof. An inner space thereof constitutes a fitting space 30 for the first connector housing 1. Bolt inserting holes 32 shown in FIG. 22 to FIG. 23B are formed on a bottom face 31, which is a lower face of the fitting space 30. The second connector housing 3 is fixed to an unillustrated desired fitting plane with bolts 33, which constitute fixing means inserted into the bolt inserting holes 32.

Figure 13:
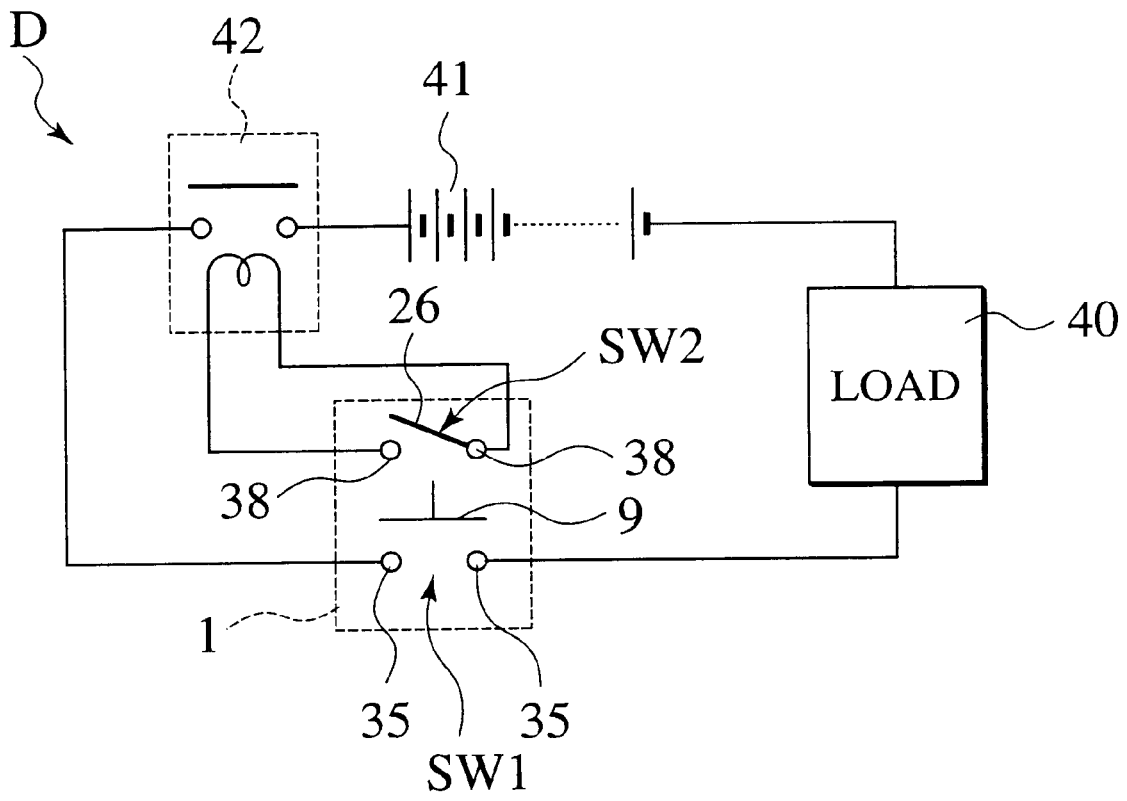
FIG. 13 is a circuit diagram of a power circuit according to the first embodiment of the present invention.

Moreover, on the bottom face 31 being the lower face of the fitting space 30, a terminal hood housing 34 is provided integrally in a protruding manner in the up-and-down direction. Inside the terminal hood housing 34, a pair of female terminals (terminals) 35 shown in FIG. 11 and FIG. 12A are severally housed therein. When the first connector housing 1 approaches from the upside of the second connector housing 3 downward, the pair of male terminals 9 on the first connector housing 1 are inserted into the terminal hood housing 34 and are connected to the pair of female terminals 35. Moreover, when the first connector housing 1 is detached from the downside toward the upside in the state where the terminals 9 and 35 are connected to one another, the pair of male terminals 9 exit from the terminal hood housing 34 and are disconnected from the pair of female terminals 35. One end of a lead line 39*a* is connected to each of the female terminals 35. One of the lead lines 39*a* is guided to a load 40 of a power circuit D, and the other lead line 39*a* is guided to a power source unit 41 of the power circuit D, respectively. In short, as shown in FIG. 13, the male terminals 9 and the female terminals 35 severally on the both connector housings 1 and 3 constitute a power switch SW1 of the power circuit D.

Moreover, the pair of cam pins 36 are provided in a protruding manner in symmetric positions on inner peripheral walls of the second connector housing 3. The pair of cam pins 36 are inserted into the cam grooves 21 on the lever 2 upon fitting the first connector housing 1. Further, a connector unit 37 is provided inside the fitting space 30 of the second connector housing 3. A pair of fitting-state detective female terminals 38 are disposed on the connector unit 37 as fitting-state detective terminals. The pair of fitting-state detective female terminals 38 and the pair of fitting-state detective male terminals 26 on the lever 2 collectively constitute a fitting-state detective switch SW2. The fitting-state detective switch SW2 is turned on by the pair of fitting-state detective female terminals 38 connecting to the pair of fitting-state detective male terminals 26 on the lever 2, and is turned off when the pair of fitting-state detective male terminals 26 on the lever 2 are disconnected. Lead lines 39*b* are severally connected to the pair of female terminals 38, and the both lead lines 39*b* are guided to a relay circuit 42 inside the power circuit D.

Next, description will be made regarding the power circuit D. As shown in FIG. 13, the power circuit D includes the load 40 and the power source unit 41 for supplying electric power to the load 40. The power switch composed of the terminals 9 and 35 on the both connector housings 1 and 3, and the relay circuit 42 are connected to the load 40 and to the power source unit 41 in series connection. The relay circuit 42 is an electric circuit to be turned on when the fitting-state detective switch SW2 is on and to be turned off when the fitting-state detective switch SW2 is off. The power switch SW1 composed of the terminals 9 and 35 on the both connector housings 1 and 3 is a mechanical switch as described above.

Figure 17A:
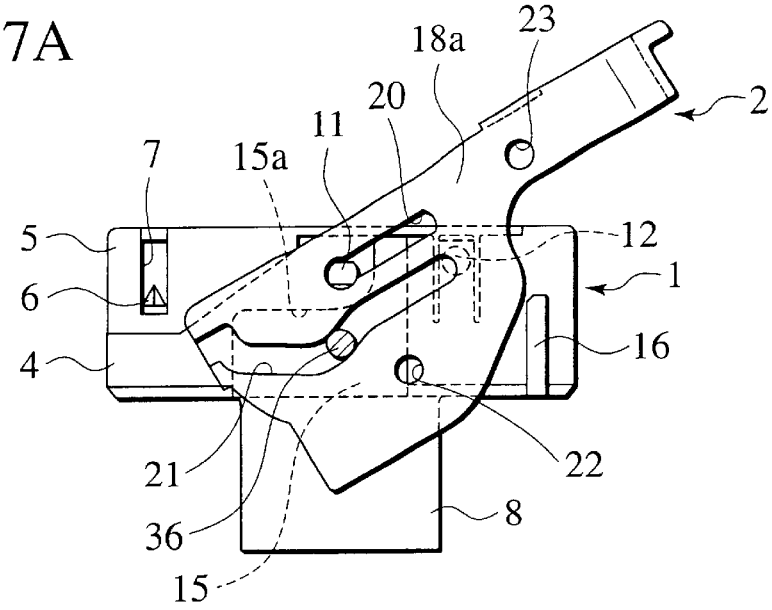
FIG. 17A is a front view of the first embodiment of the present invention for explaining a process of a movement of the cam pin upon fitting the first connector housing to the second connector housing, which shows a state where the lever is located between the rotation initial position and the rotation completive position.
Figure 17B:
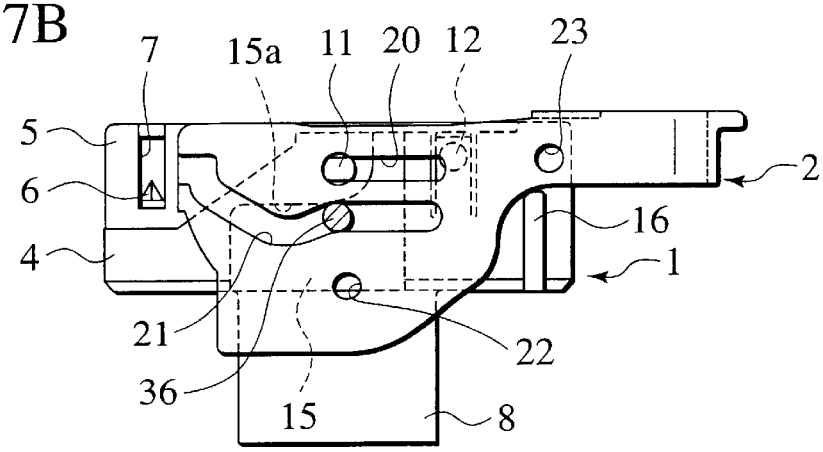
FIG. 17B is a front view of the first embodiment of the present invention for explaining the process of the movement of the cam pin upon fitting the first connector housing to the second connector housing, which shows a state where the lever is located at the rotation completive position.
Figure 17C:
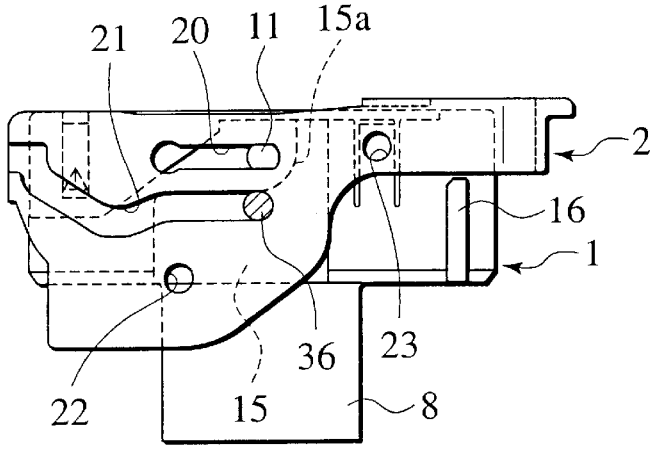
FIG. 17C is a front view of the first embodiment of the present invention for explaining the process of the movement of the cam pin upon fitting the first connector housing to the second connector housing, which shows a state where the lever is located at a fitting completive position.
Figure 18A:
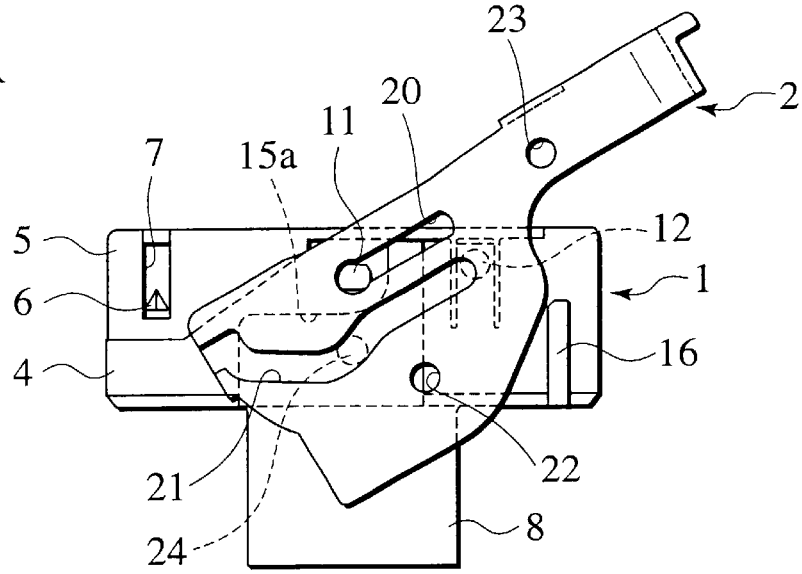
FIG. 18A is a front view of the first embodiment of the present invention for explaining a process of a movement of a lever track corrective guide pin upon fitting the first connector housing to the second connector housing, which shows a state where the lever is located between the rotation initial position and the rotation completive position.
Figure 18B:
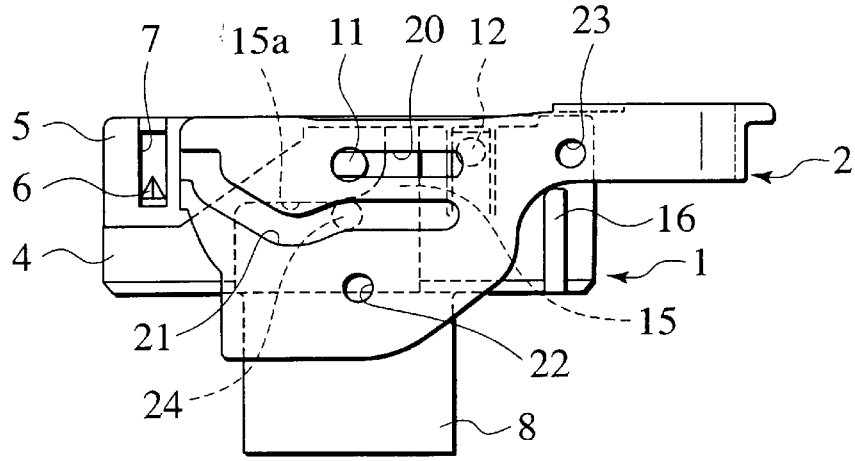
FIG. 18B is a front view of the first embodiment of the present invention for explaining the process of the movement of the lever track corrective guide pin upon fitting the first connector housing to the second connector housing, which shows a state where the lever is located at the rotation completive position.
Figure 18C:
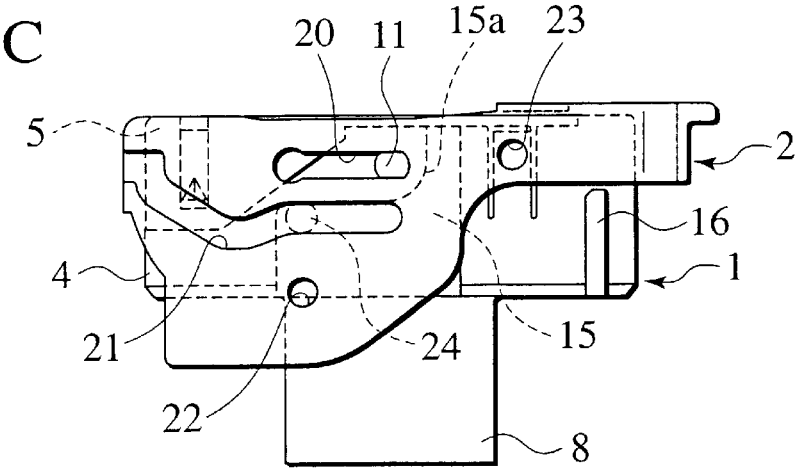
FIG. 18C is a front view of the first embodiment of the present invention for explaining the process of the movement of the lever track corrective guide pin upon fitting the first connector housing to the second connector housing, which shows a state where the lever is located at the fitting completive position.
Figure 19A:
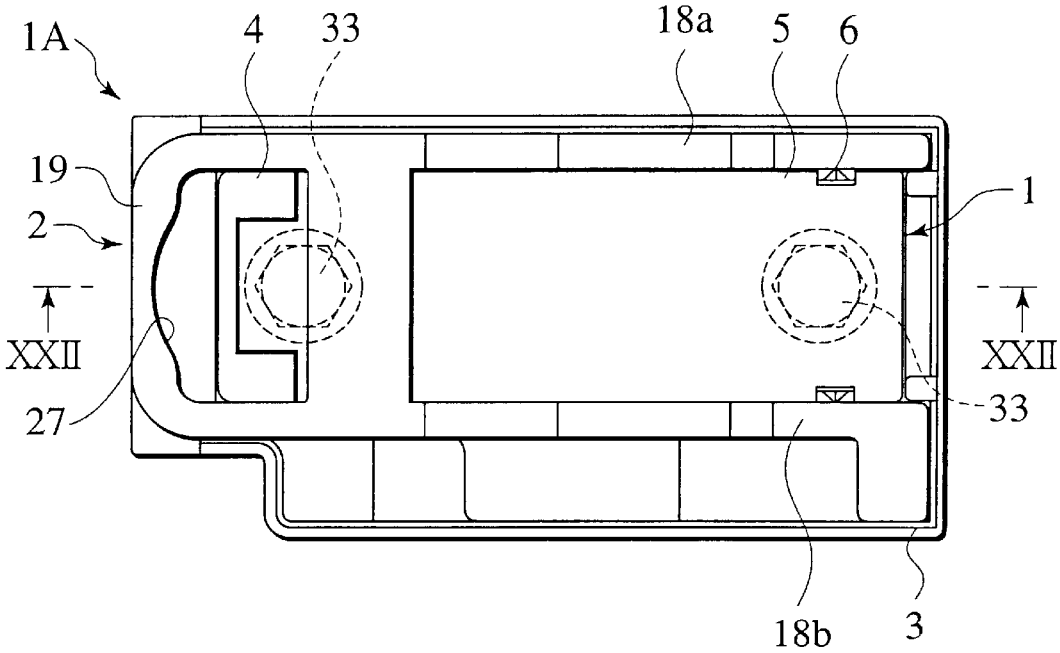
FIG. 19A is a plan view of the first embodiment of the present invention showing a state where the first connector housing is fitted completely to the second connector housing.
Figure 19B:
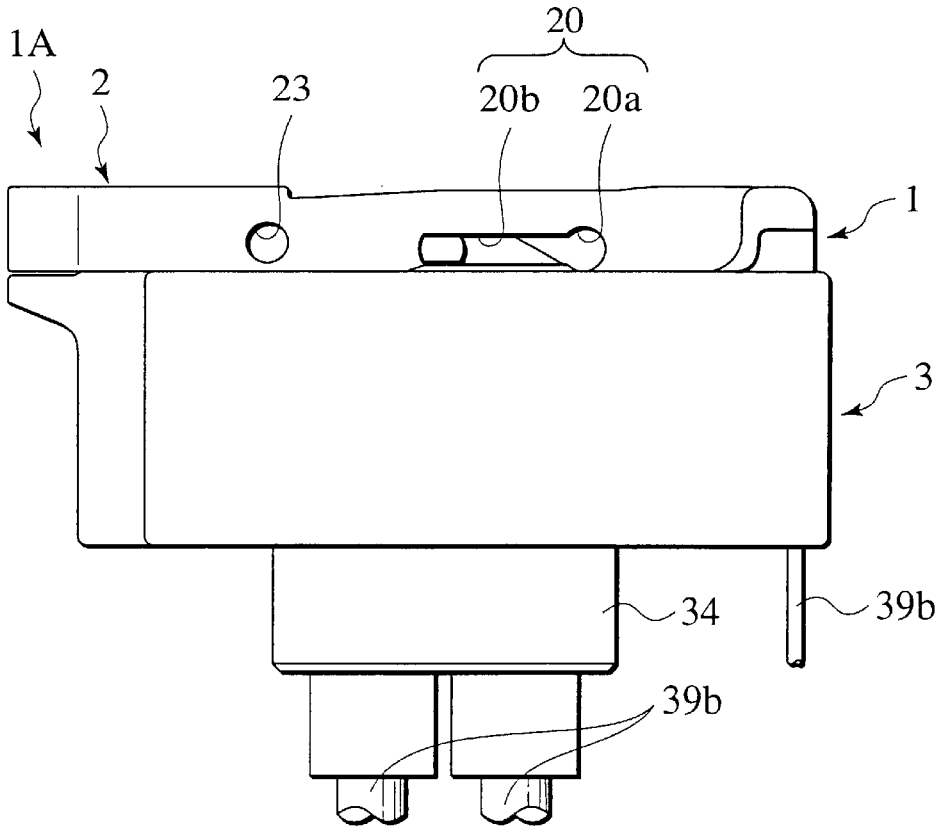
FIG. 19B is a front view of the first embodiment of the present invention showing the state where the first connector housing is fitted completely to the second connector housing.
Figure 20:
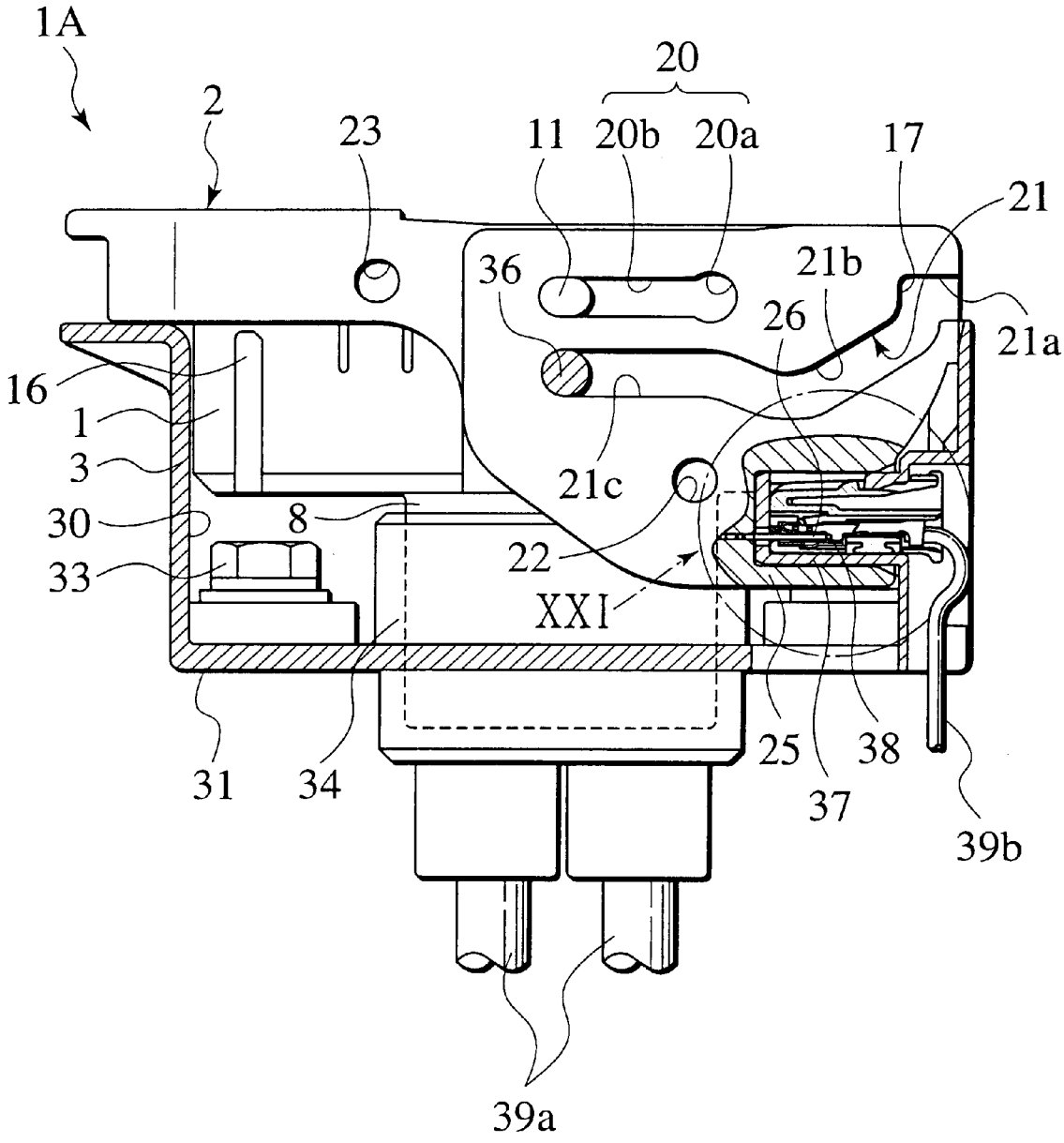
FIG. 20 is a cross-sectional view of the first embodiment of the present invention showing the state where the first connector housing is fitted completely to the second connector housing.
Figure 21:
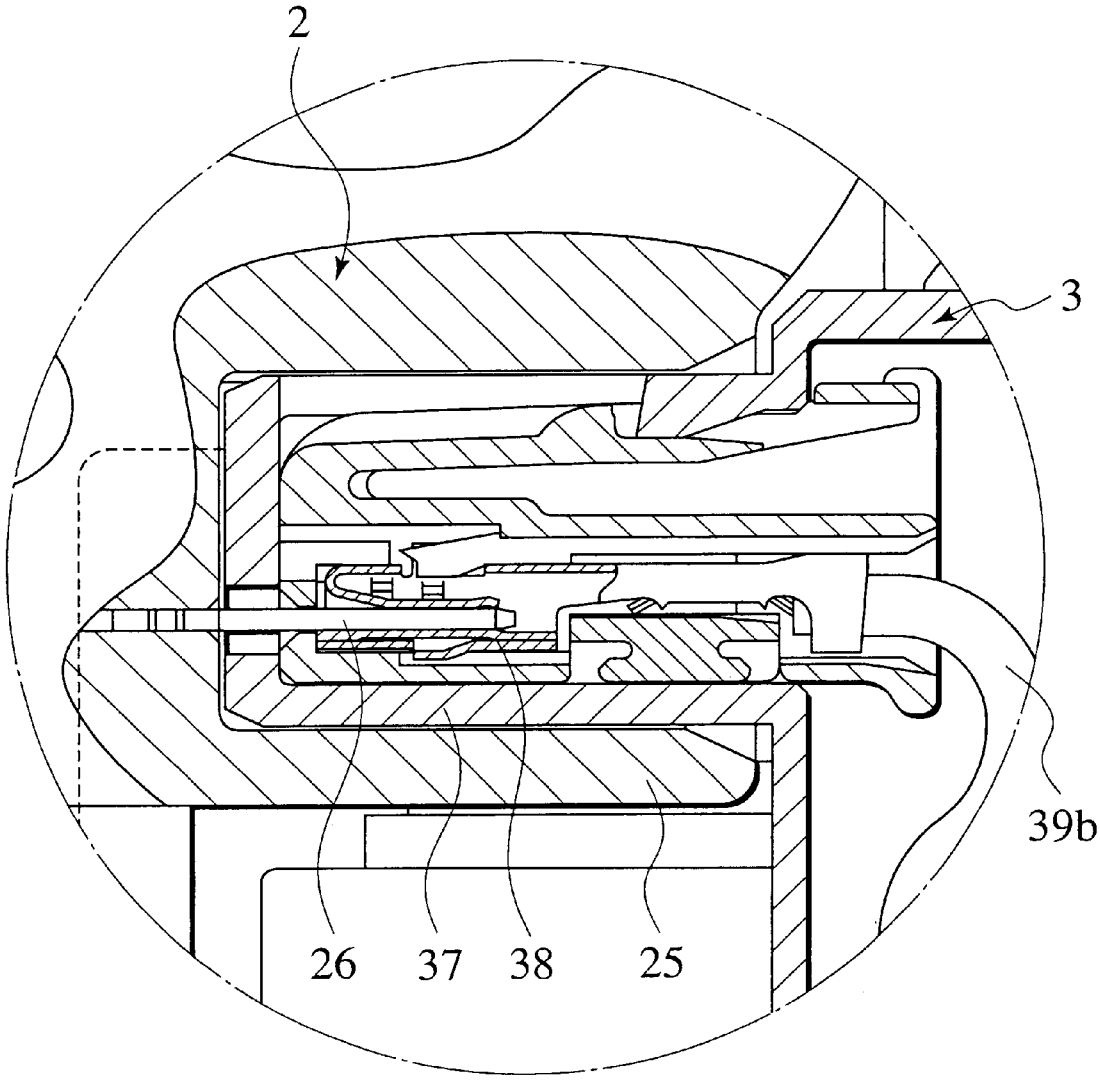
FIG. 21 is an enlarged view of principal parts of FIG. 20 showing the first embodiment of the present invention.

Next, description will be made regarding operations of the lever fitting-type manual disconnector 1A by use of FIG. 14 to FIG. 22. FIG. 14 is a perspective view showing a state before fitting the first connector housing 1 to the second connector housing 3. FIG. 15 is a perspective view showing a state where the lever 2 is located at the rotation completive position, which is a process of fitting the first connector housing 1 to the second connector housing 3. FIG. 16 is a perspective view showing a state where the first connector housing 1 is fitted completely to the second connector housing 3. FIG. 17A is a front view for explaining a process of a movement of the cam pin 36 upon fitting the first connector housing 1 to the second connector housing 3, which shows a state where the lever 2 is located between the rotation initial position and the rotation completive position. FIG. 17B is a front view for explaining the process of the movement of the cam pin 36 upon fitting the first connector housing 1 to the second connector housing 3, which shows a state where the lever 2 is located at the rotation completive position. FIG. 17C is a front view for explaining the process of the movement of the cam pin 36 upon fitting the first connector housing 1 to the second connector housing 3, which shows a state where the lever 2 is located at the fitting completive position. FIG. 18A is a front view for explaining a process of a movement of the lever track corrective guide pin 24 upon fitting the first connector housing 1 to the second connector housing 3, which shows a state where the lever 2 is located between the rotation initial position and the rotation completive position. FIG. 18B is a front view for explaining the process of the movement of the lever track corrective guide pin 24 upon fitting the first connector housing 1 to the second connector housing 3, which shows a state where the lever 2 is located at the rotation completive position. FIG. 18C is a front view for explaining the process of the movement of the lever track corrective guide pin 24 upon fitting the first connector housing 1 to the second connector housing 3, which shows a state where the lever 2 is located at the fitting completive position. FIG. 19A is a plan view showing a state where the first connector housing 1 is fitted completely to the second connector housing 3. FIG. 19B is a front view showing the state where the first connector housing 1 is fitted completely to the second connector housing 3. FIG. 20 is a cross-sectional view showing the state where the first connector housing 1 is fitted completely to the second connector housing 3. FIG. 21 is an enlarged view of principal parts of FIG. 20. FIG. 22 is a cross-sectional view taken along the XXII—XXII line in FIG. 19A.

First, description will be made regarding an operation of setting the power circuit D to a closed state with the lever fitting-type manual disconnector 1A. As shown in FIG. 14, when the first connector housing 1 is inserted from the upside of the second connector housing 3 into the fitting space 30 while setting the lever 2 in the rotation initial position, the terminal hood 8 of the first connector housing 1 is fitted and thereby inserted into the terminal hood housing 34 of the second connector housing 3; simultaneously, the pair of cam pins 36 on the second connector housing 3 are inserted into the pair of cam grooves 21 on the lever 21. Then, the pair of cam pins 36 enters the respective apertures 21*a* of the pair of come grooves 21, whereby the pair of cam pins 36 are set in the connector tentative fitting positions in which the pair of cam pins 36 abut on the respective sidewall stopper faces 17 of the pair of cam grooves 21. In the connector tentative fitting positions, the terminals 9 and 35 on the both connector housings 1 and 3 are not connected yet.

Next, when the lever 2 is rotated in the direction as illustrated with an arrow A1 in FIG. 14, the lever 2 rotates around the pair of guide pins 11 as the center from the rotation initial position shown in FIG. 14 to the rotation completive position shown in FIG. 15. Moreover, the pair of cam pins 36 on the second connector housing 3 move inside the pair of cam grooves 21 on the lever 2 as shown in FIG. 17A, whereby the first connector housing 1 gradually goes inside the second connector housing 3 in an approaching movement. Then the terminals 9 and 35 on the both connector housings 1 and 3 are connected to one another by this approaching movement before the lever is located in the rotation completive position. Moreover, the both connector housings 1 and 3 are set to a connector fitting position in the rotation completive position of the lever 2.

Next, when the lever 2 is slid in the direction as illustrated with an arrow B1 in FIG. 15, the pair of guide pins 11 slide inside the pair of guide grooves 20 on the lever 2. Simultaneously, as shown in FIG. 17B and FIG. 17C, the pair of cam pins 36 on the second connector housing 3 slide inside the pair of cam grooves 21 on the lever 2, whereby the lever 2 slides (moves linearly) from the rotation completive position shown in FIG. 15 to the fitting completive position shown in FIG. 16. By such a sliding movement, the fitting-state detective male terminals 26 on the lever 2 are connected to the pair of fitting-state detective female terminals 38 on the second connector housing 3 before the lever 2 is located in the fitting completive position. Thereafter, the relay circuit 42 is turned on when the fitting-state detective switch SW2 is turned on, whereby the power circuit D is set to the closed state for the first time.

Next, description will be made regarding an operation for setting the power circuit D from the closed state to an open state (disconnection of the power source) with the lever fitting-type manual disconnector 1A. Starting from the state as shown in FIG. 16, the lever 2 is slid in the direction as illustrated with an arrow B2 in FIG. 16. Then, the pair of guide pins 11 slide inside the pair of guide grooves 20 on the lever 2. Simultaneously, the pair of cam pins 36 on the second connector housing 3 slide inside the pair of cam grooves 21 on the lever 2, whereby the lever 2 slides from the fitting completive position shown in FIG. 16 to the rotation completive position shown in FIG. 15. By such a sliding movement, the fitting-state detective male terminals 26 on the lever 2 are detached and disconnected from the pair of fitting-state detective female terminals 38 on the second connector housing 3 before the lever 2 is located in the rotation completive position. Moreover, the relay circuit 42 is turned off when the fitting-state detective switch SW2 is turned off, whereby the power circuit D is already set to the open state at this point.

Next, the lever 2 is rotated in the direction as illustrated with an arrow A2 in FIG. 15. Then, the lever 2 rotates around the pair of guide pins 11 as the center from the rotation completive position shown in FIG. 15 to the rotation initial position shown in FIG. 14. Meanwhile, the pair of cam pins 36 on the second connector housing 3 moves inside the pair of cam grooves 21 on the lever 2, whereby the first connector housing 1 is gradually detached upward and drawn out of the second connector housing 3. Moreover, by such a detaching movement, the terminals 9 and 35 on the both connector housings 1 and 3 are disconnected before the lever 2 is located in the rotation initial position; simultaneously, the both connector housings 1 and 3 are set to the connector tentative fitting position in the rotation initial position of the lever 2.

If an operator wishes to detach the first connector housing 1 from the second connector housing 3 completely, then the operator may pull out the first connector housing 1 upward from the second connector housing 3.

As described above, according to the lever fitting-type manual disconnector 1A, the terminals 9 and 35 on the both connector housings 1 and 3 are connected to one another in the process of rotating the lever 2 from the rotation initial position to the rotation completive position, whereby the power switch SW1 is turned on. Nevertheless, the power circuit D remains open in this state. The fitting-state detective switch SW2 is turned on in the process of sliding (linearly moving) the lever 2 from the rotation completive position to the fitting completive position. Accordingly, the relay circuit 42 is turned on and the power circuit D is thereby set to the closed state for the first time. Therefore, it is surely possible to prevent the power circuit D from being set to the closed state in the process of operating the lever 2. Accordingly, since the operations of the lever 2 are not completed, recognition of the open state of the power circuit D may take place correctly. In this way, it is possible to prevent accidents from occurring.

Moreover, upon setting the power circuit D from the closed state to the open state, the fitting-state detective switch SW2 is turned off in the process of linearly moving the lever 2 from the fitting completive position to the rotation completive position, whereby the relay circuit 42 is turned off and the power circuit D is set to the open state. In addition, the power switch SW1 composed of the terminals 9 and 35 are detached in the process of rotating the lever 2 from the rotation completive position to the rotation initial position. Accordingly, there is a time lag since the power circuit D is turned off until the power switch composed of the terminals 9 and 35 is detached. Therefore, sufficient time for electric discharge is secured, and it is thereby possible to prevent occurrence of arc discharge.

In short, the operation with the lever 2 for setting the power circuit D to the closed state includes two actions of the rotating operation and the sliding operation. The power circuit D is set to the closed state by the latter sliding operation. Meanwhile, the operation with the lever 2 for setting the power circuit D to the open state includes two actions reverse to the foregoing. The power circuit D is turned off in the former sliding operation, and the power switch SW1 composed of the terminals 9 and 35 is turned off afterward in the subsequent rotating operation. In this way, it is possible to secure the discharge time.

Figure 23A:
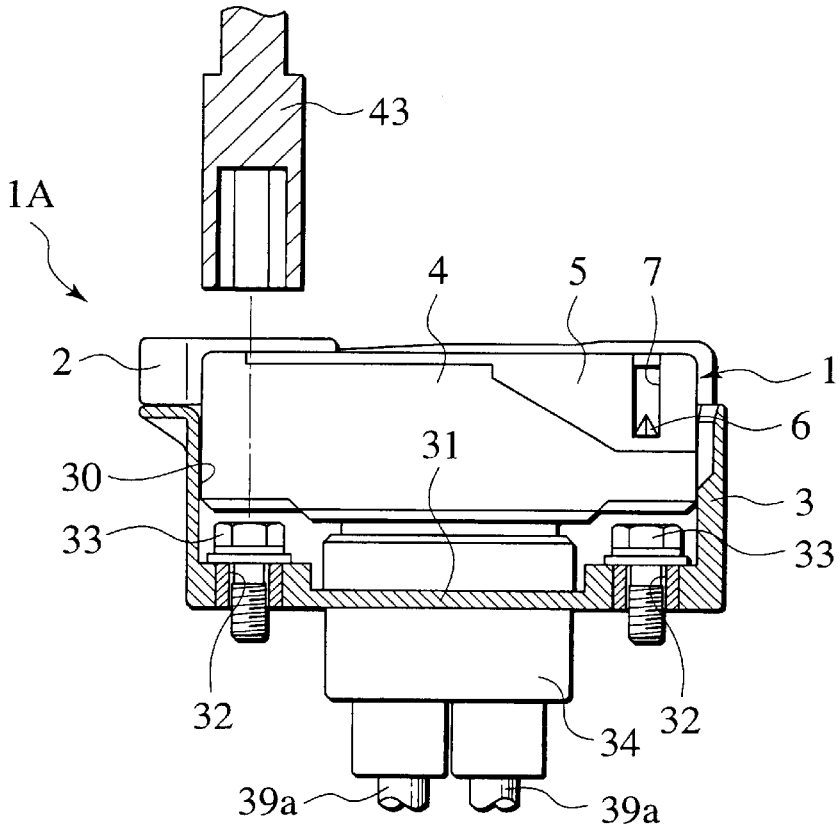
FIG. 23A is a cross-sectional view of the first embodiment of the present invention for explaining that a bolt fitting tool cannot be fitted to a bolt in the state where the first connector housing is fitted to the second connector housing.
Figure 23B:
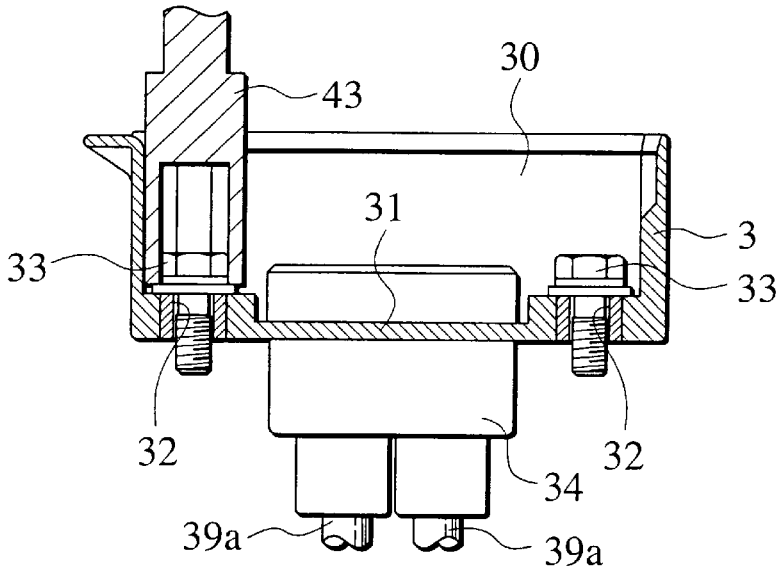
FIG. 23B is a cross-sectional view of the first embodiment of the present invention for showing a state where the bolt fitting tool is fitted to the bolt in a state that the first connector housing is detached from the second connector housing.

In the meantime, FIG. 23A is a cross-sectional view for explaining that a bolt fitting tool 43 (a tool) cannot be fitted to the bolt 33 in the state where the first connector housing 1 is fitted to the second connector housing 3. FIG. 23B is a cross-sectional view for showing a state where the bolt fitting tool 43 is fitted to the bolt 33 in a state that the first connector housing 1 is detached from the second connector housing 3. According to the first embodiment, as shown in FIG. 23A, the bolt fitting tool 43 cannot be fitted to the bolt 33 if the first connector housing 1 is fitted to the second connector housing 3. Therefore, it is impossible to detach the second connector housing 3.

Moreover, as shown in FIG. 23B, the bolt fitting tool 43 can be fitted to the bolt 33 and the second connector housing 3 can be thereby detached from the fitting plane only if the first connector housing 1 is detached from the second connector housing 3. Therefore, upon detaching the second connector housing 3 from the fitting plane for the purpose of repairing or the like, the second connector housing 3 is detachable from the fitting plane only if the pairs of terminals 9 and 35 are disconnected. In this way, safety for an operator can be sufficiently secured.

Furthermore, according to the first embodiment, the sliding operation of the lever 2 located in the fitting completive position is feasible by putting only one finger into the finger inserting hole 27. Therefore, in the operation for sliding the lever 2 from the fitting completive position to the rotation completive position, there is no other choice but the operator must operate the lever 2 using one finger. Accordingly, the operator is required to change a grip in the subsequent rotating operation. As a result, a large time-lag takes place since the power circuit D is turned off until the power switch SW1 composed of the terminals 9 and 35 is detached, whereby sufficient discharge time is secured. Eventually, it is surely possible to prevent occurrence of arc discharge.

Furthermore, according to the first embodiment, the lever track corrective guide pins 24 are provided on the lever 2 and the lever track corrective grooves 15 for engaging with the lever track corrective guide pins 24 are provided on the first connector housing 1. Therefore, as shown in FIGS. 18A to 18C, the rotational movement and the linear movement of the lever 2 are controlled not only by the guide pins 11 and the guide grooves 20 but also by the lever track corrective guide pins 24 and the lever track corrective guide grooves 15. For this reason, the lever 2 does not initiate rotation in a position other than the predetermined rotational position. Accordingly, it is possible to prevent damages on the lever 2 or the guide pins 11. Moreover, even if rotational force is applied in order to rotate the lever 2 in the position other than the predetermined rotational position, such rotational force is also received by the lever track corrective guide pins 24 and by the lever track corrective guide grooves 15. In this regard, damages on the lever 2 or the guide pins 11 can be prevented sufficiently.

Furthermore, according to the embodiment, the lever track corrective guide pins 11 are provided on the lever 2 and the lever track corrective guide grooves 15 are provided on the first connector housing 1, respectively. However, to the contrary, it is also possible to provide the lever track corrective guide pins 11 on the first connector housing 1 and to provide the lever track corrective guide grooves 24 on the lever 2, respectively. In this way, design freedom is enhanced.

Furthermore, according to the first embodiment, as shown in FIG. 14 and FIG. 16, the retaining protrusions 12 of the first connector housing 1 are inserted into and retained at the first retaining holes 22 of the lever 2 in the rotation initial position, and the retaining protrusion 12 of the first connector housing 1 are inserted into and retained at the second retaining holes 23 of the lever 2 in the fitting completive position. In this way, the lever 2 is retained not only in the fitting completive position but also in the rotation initial position. Therefore, the lever 2 is located and retained at the desired rotational position upon fitting the first connector housing 1 into the second connector housing 3, whereby positions of the apertures 21*a* of the cam grooves 21 of the lever 2 and the cam pins 36 of the second connector housing 3 surely coincide with one another. In this way, workability is enhanced.

Moreover, according to the embodiment, the same retaining protrusions 12 are used for retention with the first retaining holes 22 and with the second retaining holes 23 of the lever 2. In this way, just the pair of retaining protrusions 12 are required therein, and the constitution is thereby simplified.

Furthermore, according to the embodiment, the retaining protrusions 12 are provided on the flexible arms 14, which are elastically deformable in the direction of escaping from the first retaining holes 22 or the second retaining holes 23. Therefore, if moving force is applied to the lever 2 located in the rotation initial position or the fitting completive position, then the retaining protrusions 12 are disengaged from the first retaining holes 22 or the second retaining holes 23 owing to elastic flexure deformation of the flexible arms 14. In this way, it is possible to operate the lever 2 smoothly. Moreover, the retaining protrusions 12 suffer from less damages when the retaining protrusions 12 are engaged with or disengaged from the first retaining holes 22 or the second retaining holes 23. Accordingly, the flexible arms 14 are effective in damage prevention for the retaining protrusions 12.

Moreover, according to the first embodiment, the first retaining holes 22 and the second retaining holes 23 are provided on the lever 2, and the retaining protrusions 12 are provided on the first connector housing 1, respectively. However, to the contrary, it is also possible to provide the first retaining holes 22 and the second retaining holes 23 on the first connector housing 1 and to provide the retaining protrusions 12 on the lever 2, respectively. In this way, design freedom is enhanced.

Further, according to the first embodiment, the cam grooves 21 are provided on the lever 2 and the cam pins 36 are provided on the second connector housing 3, respectively. However, to the contrary, it is also possible to provide the cam grooves 21 on the second connector housing 3 and to provide the cam pins 36 on the lever 2, respectively. In this way, design freedom is enhanced. Still further, according to the first embodiment, the guide grooves 20 are provided on the lever 2 and the guide pins 11 are provided on the first connector housing 1, respectively. However, to the contrary, it is also possible to provide the guide grooves 20 on the first connector housing 1 and to provide the guide pins 11 on the lever 2, respectively. In this way, design freedom is enhanced.

Figure 24A:
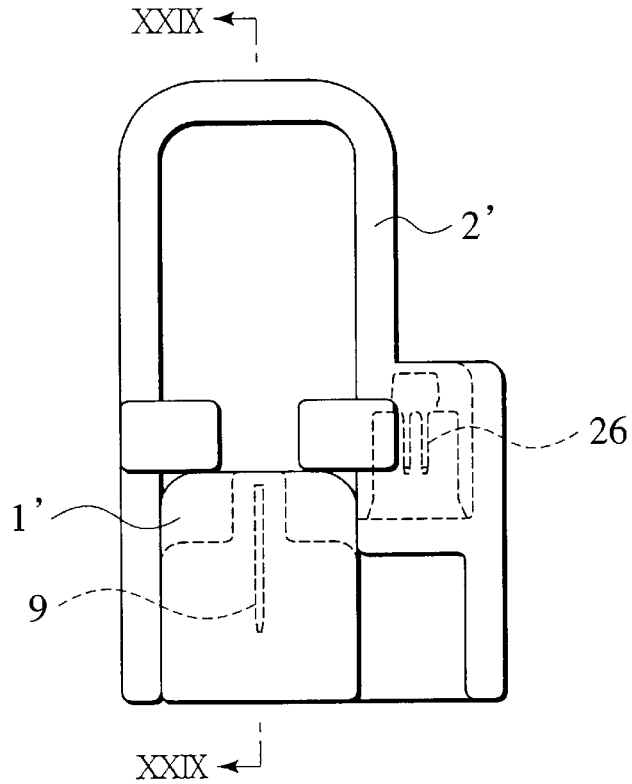
FIG. 24A is a front view of a first connector housing fitted with a lever according to a second embodiment of the present invention.
Figure 24B:
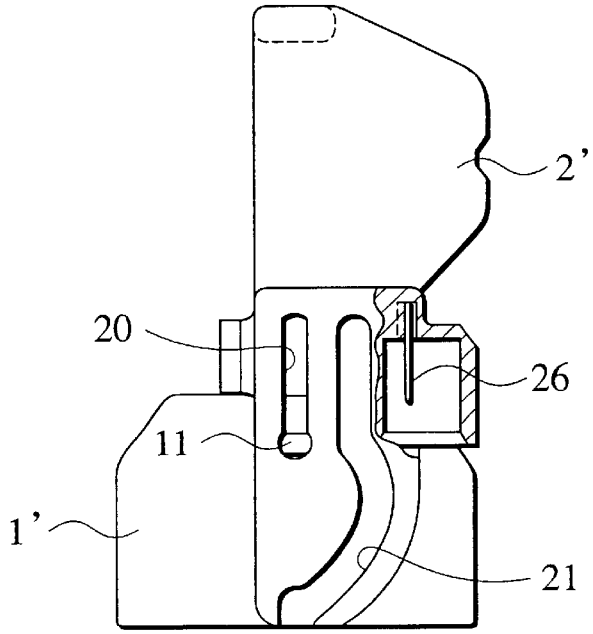
FIG. 24B is a side view of the first connector housing fitted with the lever according to the second embodiment of the present invention.
Figure 24C:
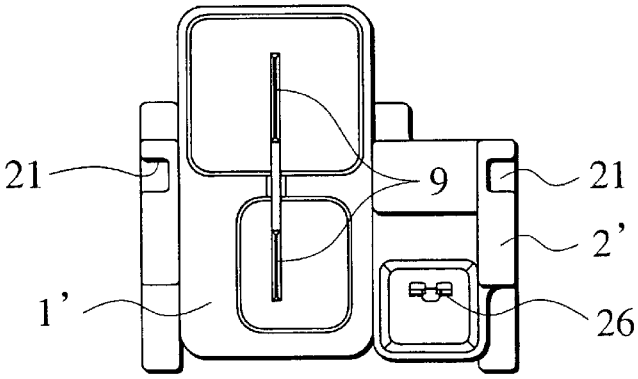
FIG. 24C is a bottom view of the first connector housing fitted with the lever according to the second embodiment of the present invention.
Figure 25:
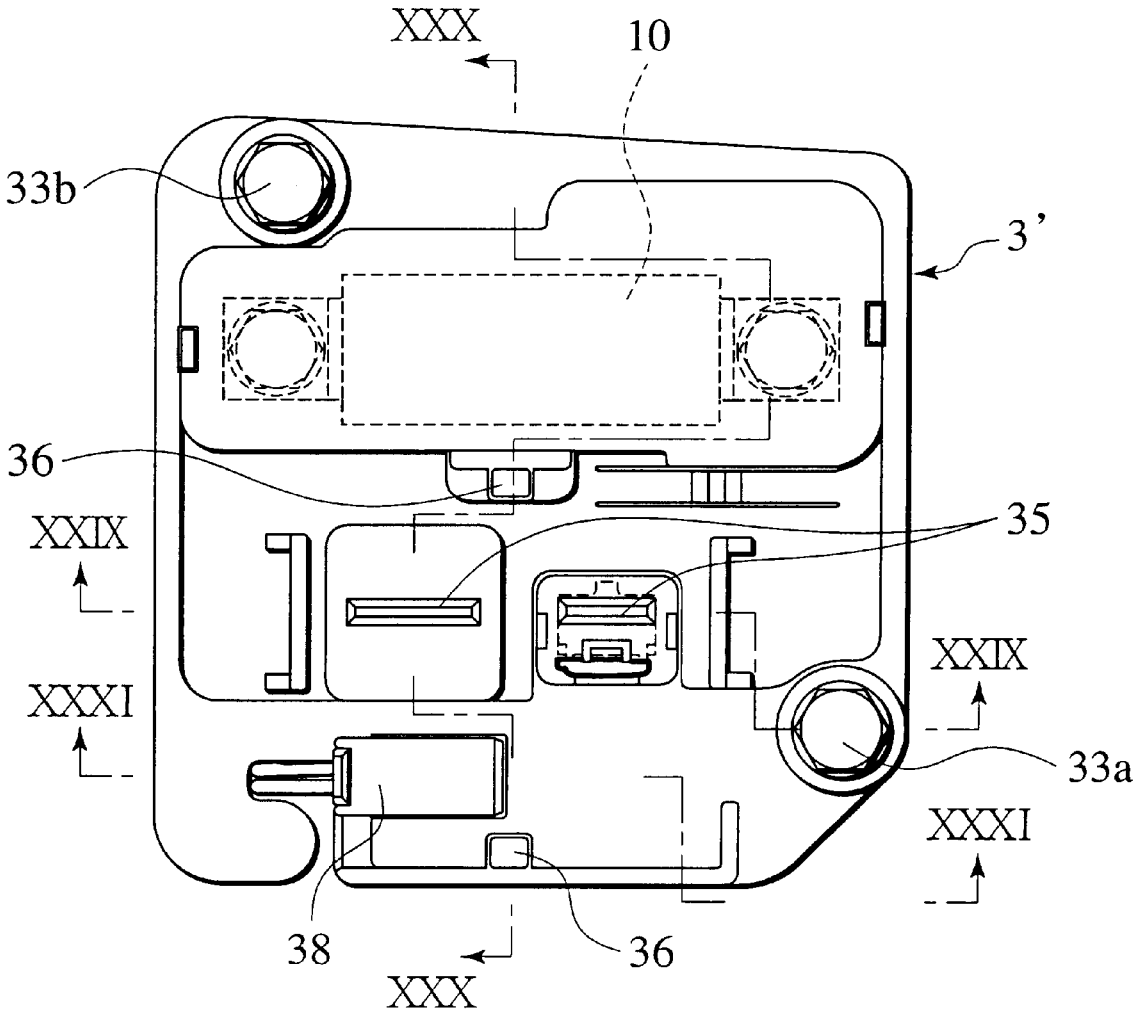
FIG. 25 is a plan view of a second connector housing according to the second embodiment of the present invention.
Figure 26:
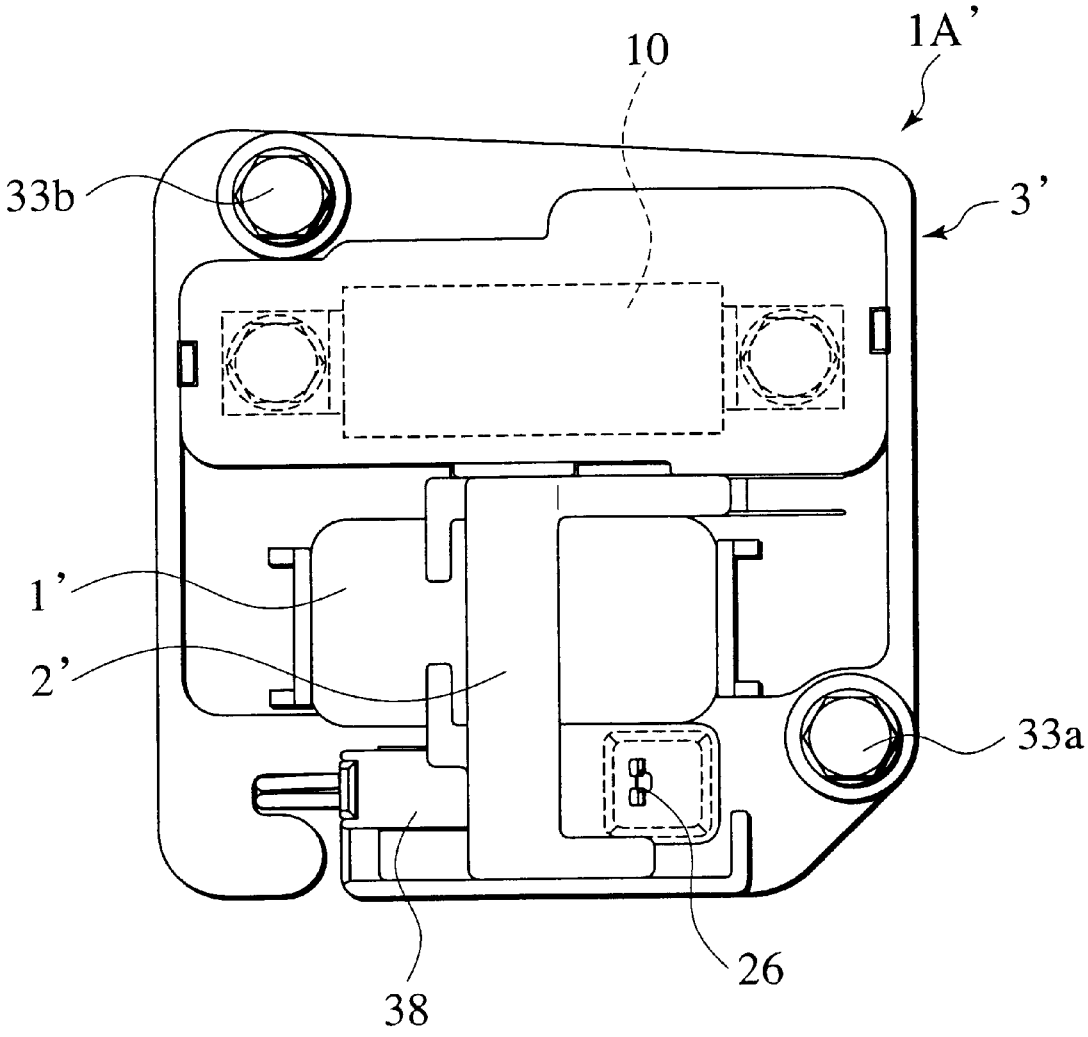
FIG. 26 is a plan view of the second embodiment of the present invention, showing a state in the process of fitting the first connector housing to the second connector housing, in which the lever is located at a rotation initial position.
Figure 27:
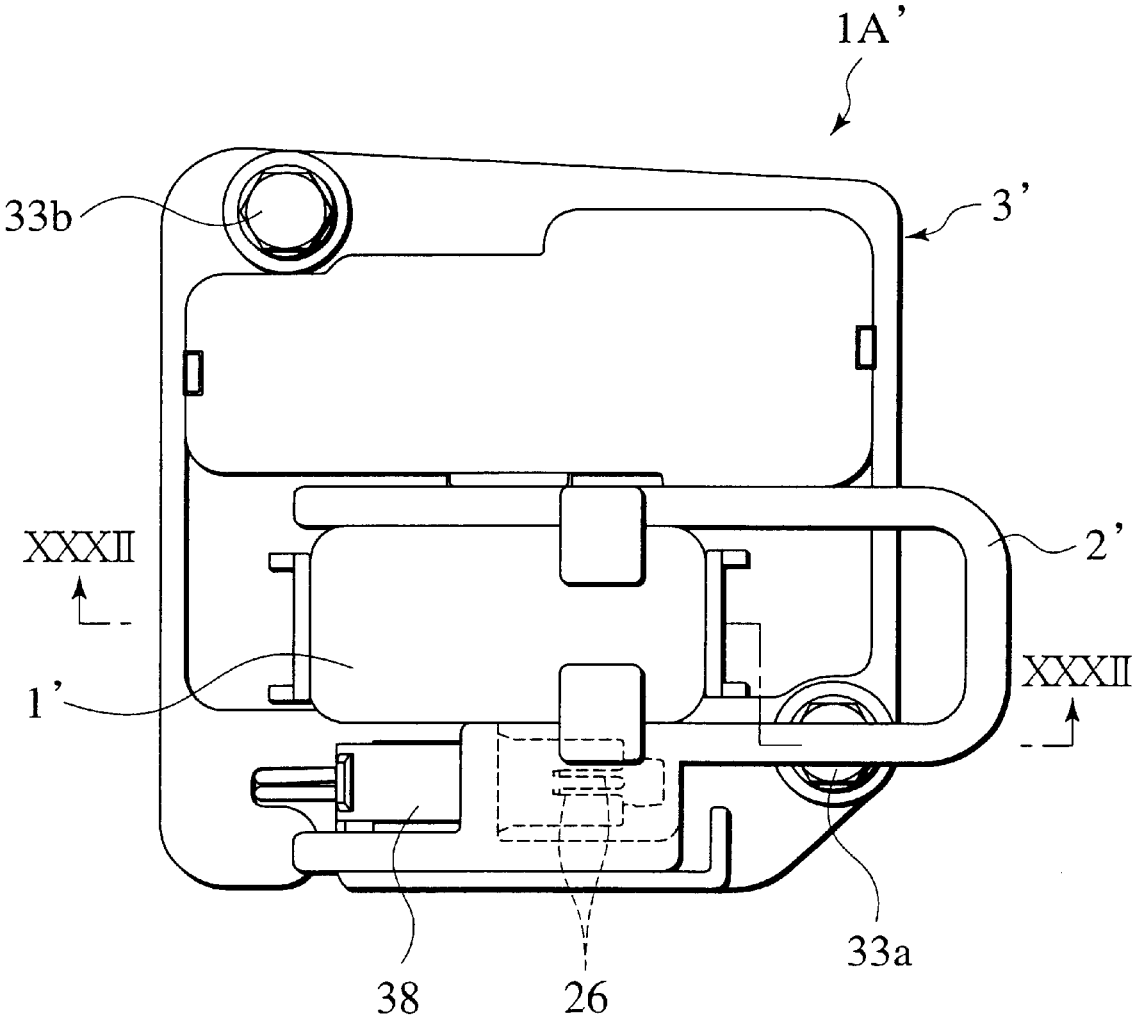
FIG. 27 is a plan view of the second embodiment of the present invention, showing a state in the process of fitting the first connector housing to the second connector housing, in which the lever is located at a rotation completive position.
Figure 28:
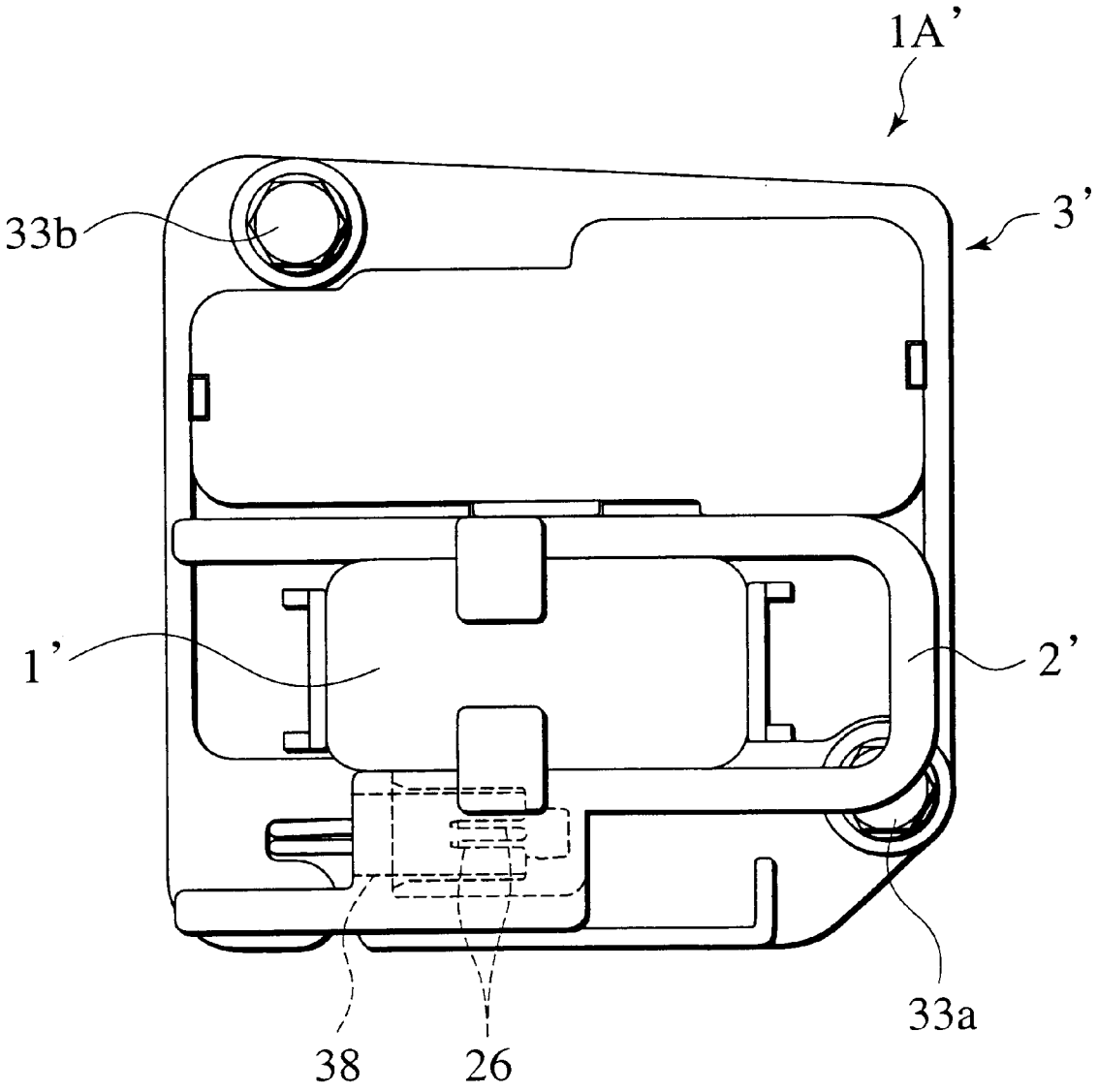
FIG. 28 is a plan view of the second embodiment of the present invention, showing a state where the first connector housing is fitted completely to the second connector housing, in which the lever is located at a fitting completive position.
Figure 29:
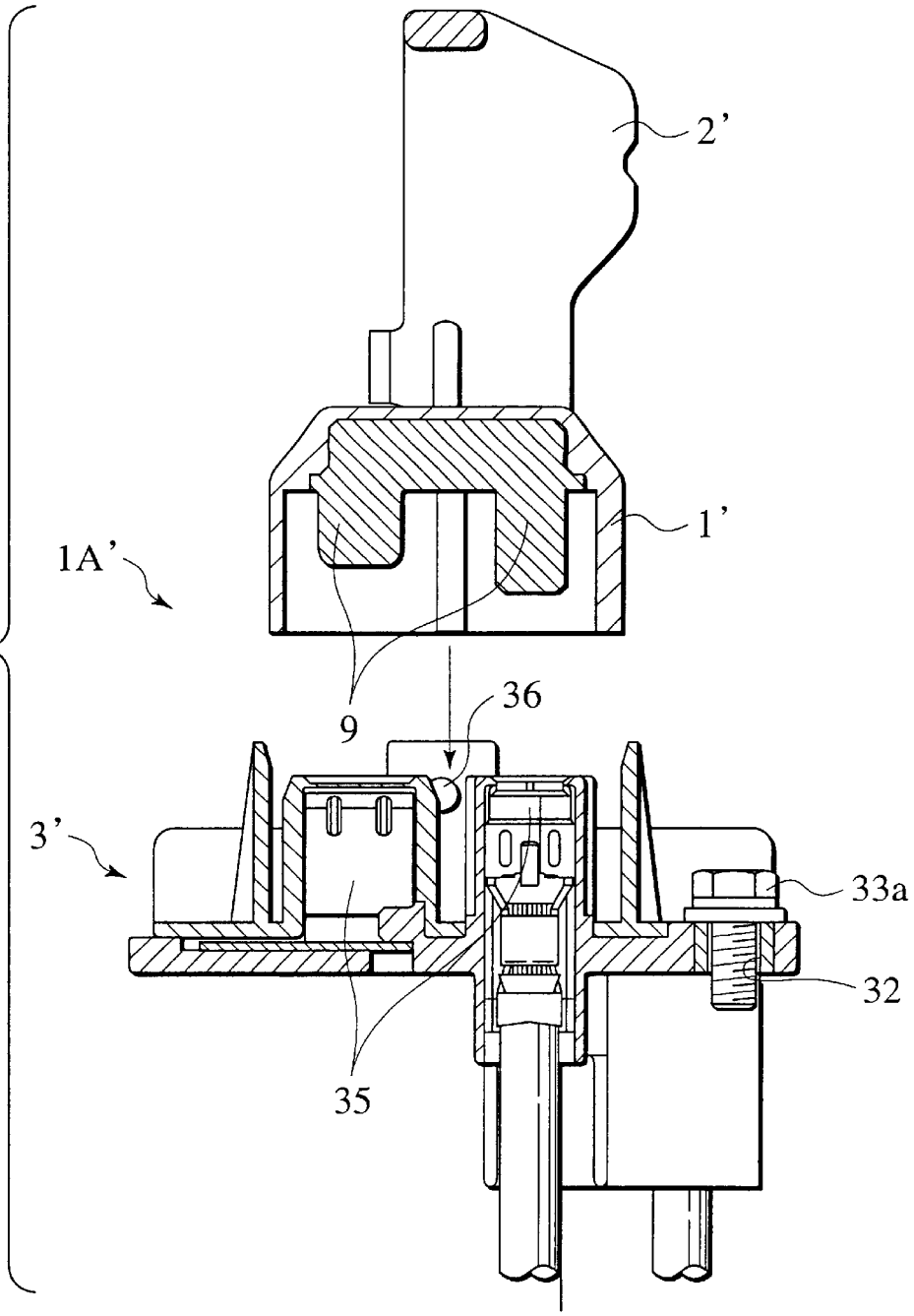
FIG. 29 is a cross-sectional view of the second embodiment of the present invention showing a state of inserting the first connector housing into the second connector housing, which corresponds to the XXIX—XXIX line in FIG. 24A and the XXIX—XXIX line in FIG. 25.
Figure 30:
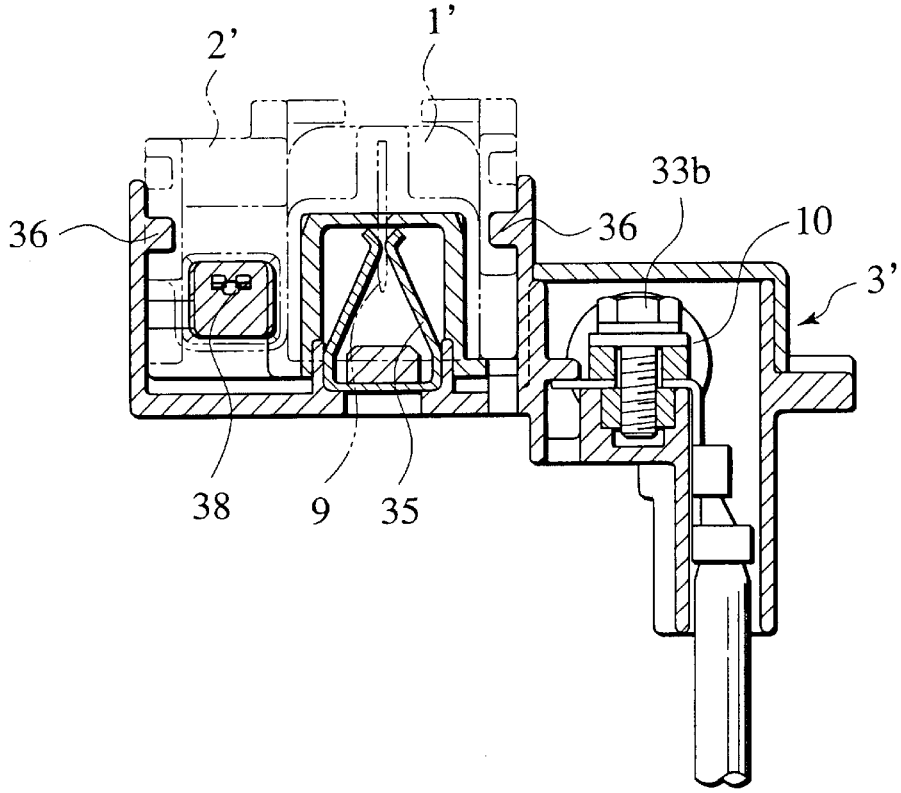
FIG. 30 is a cross-sectional view of the second embodiment of the present invention, which is taken along the XXX—XXX line in FIG. 25.
Figure 31:
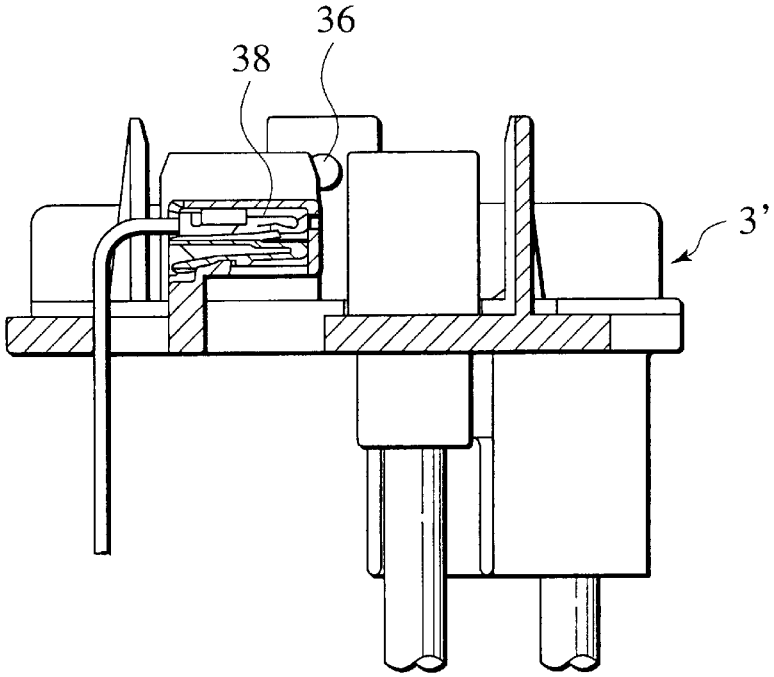
FIG. 31 is a cross-sectional view of the second embodiment of the present invention, which is taken along the XXXI—XXXI line in FIG. 25.
Figure 32:
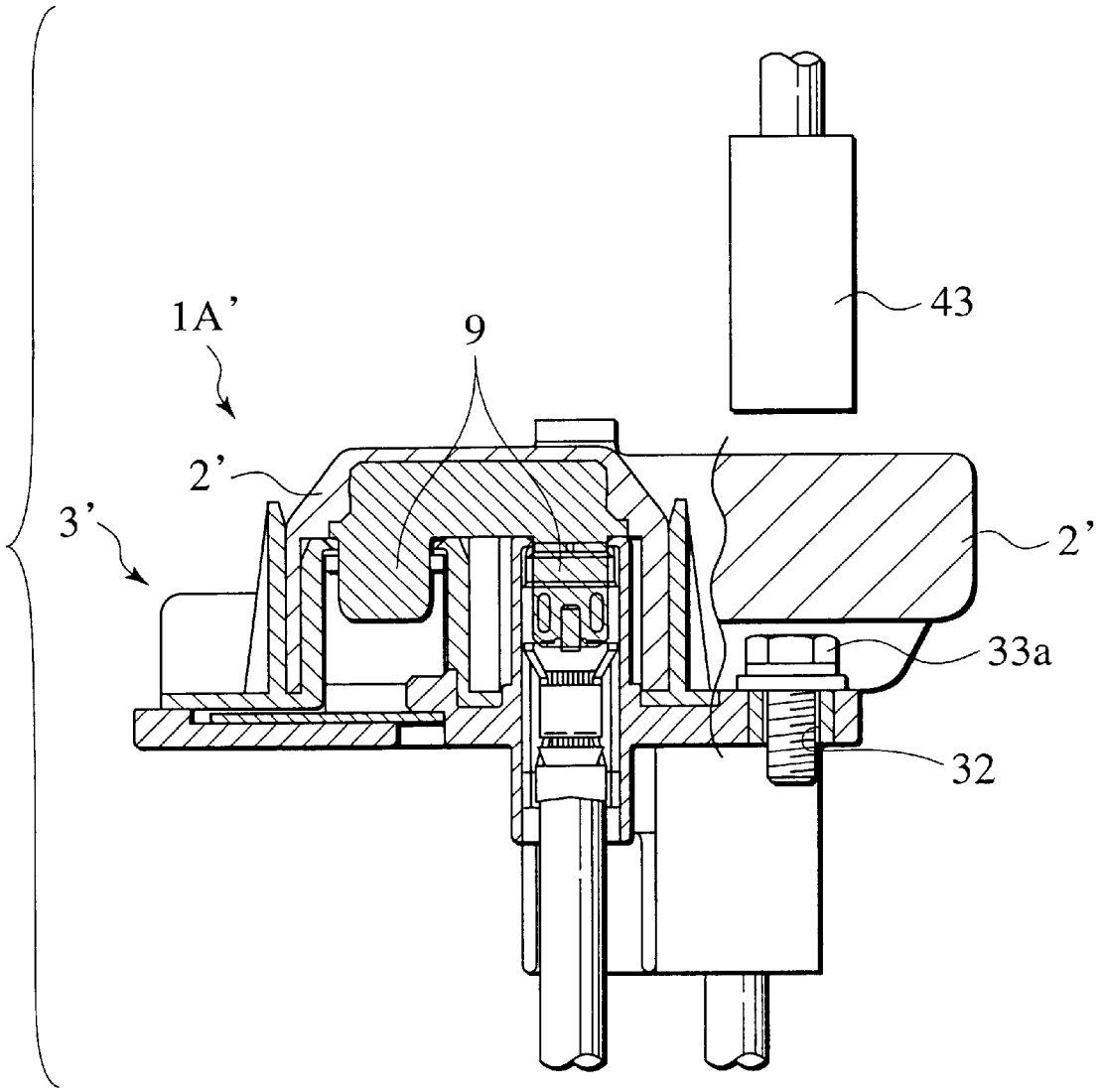
FIG. 32 is a cross-sectional view of the second embodiment of the present invention, which is taken along the XXXII—XXXII line in FIG. 27.

FIG. 24A to FIG. 32 collectively show a lever fitting-type manual disconnector for a high-voltage and large-current circuit according to a second embodiment of the present invention. FIG. 24A is a front view of a first connector housing fitted with a lever. FIG. 24B is a side view of the first connector housing fitted with the lever. FIG. 24C is a bottom view of the first connector housing fitted with the lever. FIG. 25 is a plan view of a second connector housing. FIG. 26 is a plan view showing a state in the process of fitting the first connector housing to the second connector housing, in which the lever is located at a rotation initial position. FIG. 27 is a plan view showing a state in the process of fitting the first connector housing to the second connector housing, in which the lever is located at a rotation completive position. FIG. 28 is a plan view showing a state where the first connector housing is fitted completely to the second connector housing, in which the lever is located at a fitting completive position. FIG. 29 is a cross-sectional view showing a state of inserting the first connector housing into the second connector housing, which corresponds to the XXIX—XXIX line in FIG. 24A and the XXIX—XXIX line in FIG. 25. FIG. 30 is a cross-sectional view taken along the XXX—XXX line in FIG. 25. FIG. 31 is a cross-sectional view taken along the XXXI—XXXI line in FIG. 25. FIG. 32 is a cross-sectional view taken along the XXXII—XXXII line in FIG. 27.

As similar to the first embodiment, a lever fitting-type manual disconnector 1A' of the second embodiment includes a first connector housing 1' made of plastics, a lever 2' made of plastics which is fitted to the first connector housing 1', and a second connector housing 3' made of plastics to which the first connector housing 1' is fitted by an operation with the lever 2'.

The first connector housing 1' is provided with a pair of male terminals 9, guide pins 11 and the like, which have similar functions to those in the first embodiment. The lever 2' is provided with guide grooves 20, cam grooves 21, fitting-state detective male terminals 26 and the like, which have similar functions to those in the first embodiment. The second connector housing 3' is provided with a pair of female terminals 35, cam pins 36, a pair of fitting-state detective female terminals 38 and the like, which have similar functions to those in the first embodiment. In the following, constituents as the same as those in the first embodiment are denoted by the same reference numerals, and detail description thereof will be omitted.

Meanwhile, as similar to the first embodiment, the fitting-state detective male terminals 26 and the fitting-state detective female terminals 38 collectively constitute a fitting-state detective switch SW2 (refer to FIG. 13). A relay circuit 42 to be turned on and off by the fitting-state detective switch SW2 and a power switch SW1 composed of respective terminals 9 and 35 on the both connector housings 1' and 3' are interposed in a power circuit D in series connection.

Now, differences between this second embodiment and the first embodiment are as follows. Specifically, although the fuse 10 is housed inside the first connector housing 1 according to the first embodiment, a fuse 10 is housed inside the second connector housing 3' according to the second embodiment. Moreover, according to the first embodiment, the bolt inserting holes 32 are provided inside the fitting space 30 within the second connector housing 3, and the second connector housing 3 is fixed to the unillustrated fitting plane with the bolts 33 being fixing means inserted into the respective bolt inserting holes 32. In other words, according to the first embodiment, the first connector housing 1 to be fitted to the second connector housing 3 is disposed in a position right above the bolts 33. On the contrary, in this second embodiment, bolt inserting holes 32 are provided in two positions which are not positions right below the first connector housing 1' to be fitted to the second connector housing 3'. Moreover, the second connector housing 3' is fixed to an unillustrated fitting plane with bolts 33*a* and 33*b* being fixing means inserted into the respective bolt inserting holes 32.

Now, the bolt 33*a* to be inserted into one of the bolt inserting holes 32 is disposed in a position where the lever 2' is placed right above the bolt 33*a* in the case where the first connector housing 1' is inserted into the second connector housing 3' and the lever 2' is located in the rotation completive position shown in FIG. 27 or in the fitting completive position shown in FIG. 28. In other words, the bolt 33*a* is disposed in the position where the lever 2' is not placed right above the bolt 33*a* in the case where the lever 2' is located in the rotation initial position shown in FIG. 26.

In the lever fitting-type manual disconnector 1A' according to the second embodiment as well, the lever 2' is set to the rotation initial position and the first connector housing 1' is allowed to approach the second connector housing 3' from the upside thereof, whereby the pair of cam pins 36 on the second connector housing 3' are inserted into the pair of cam grooves 21 on the lever 2'. Thereafter, the lever 2' is rotated from the rotation initial position shown in FIG. 26 to the rotation completive position shown in FIG. 27, and then the lever 2' is moved linearly (slid) from the rotation completive position shown in FIG. 27 to the fitting completive position shown in FIG. 28, whereby the power circuit D can be set to a closed state. Moreover, the power circuit D can be set to an open state by moving the lever 2' located in the fitting completive position toward the rotation initial position in accordance with reverse action to the foregoing. Furthermore, in the lever fitting-type manual disconnector 1A' according to the second embodiment as well, it is possible to obtain various effects similar to those in the lever fitting-type manual disconnector 1 according to the first embodiment Moreover, according to this second embodiment, in the state that the first connector housing 1' is fitted to the second connector housing 3' and the terminals 9 and 35 on the both connector housings are located in a position of a connected state (in the rotation completive position and the fitting completive position of the lever 2') as shown in FIG. 27 and FIG. 28, a bolt fitting tool (a tool) 43 shown in FIG. 32 cannot be fitted to the bolt 33*a*. Accordingly, it is not possible to detach the second connector housing 3'. On the contrary, the bolt fitting tool 43 can be fitted to the bolt 33*a* and the second connector housing 3' can be thereby detached from the fitting plane only if the first connector housing 1' is detached from the second connector housing 3' or if the first connector housing 1' is fitted to the second connector housing 3' but the terminals 9 and 35 on the both connector housings are located in a position of an unconnected state (in the rotation initial position of the lever 2'). Therefore, it is possible to secure safety for an operator sufficiently upon detaching the second connector housing 3' from the fitting plane for the purpose of repairing and the like.

In particular, since the bolt fitting tool 43 cannot be fitted to the bolt 33*a* not only when the lever 2' is located in the fitting completive position but also when the lever 2' is located in the rotation completive position as illustrated in FIG. 28, it is also possible to secure safety for the operator sufficiently in the case where the relay circuit 42 is constantly set to the closed state due to a failure in the fitting-state detective switch SW2. Moreover, since the second connector housing 3' is detachable in the rotation initial position of the lever 2', it is possible to perform a detaching operation even in the state where the first connector housing 1' is fitted, while securing safety for the operator sufficiently.

Moreover, in this second embodiment as well as in the first embodiment, the first connector housing 1 or the lever 2' is arranged to be disposed in the position right above the bolt 33 or 33*a* in order to inhibit fitting of the bolt fitting tool 43 because the bolts 33, 33*a* and 33*b* are the fixing means. However, members other than bolts can be also used as the fixing means as long as such fixing means can fix the second connector housing 3 or 3' to the fitting plane. Moreover, when the first connector housing 1 or 1' is fitted to the second connector housing 3 or 3' and the terminals 9 and 35 on the both connector housings are set in the position of the contacted state, the first connector housing 1 or 1', or the lever 2 or 2' should be disposed in a position so as to inhibit fitting of the tool to the fixing means.

Moreover, according to the second embodiment, the cam grooves 21 are provided on the lever 2' and the cam pins 36 are provided on the second connector housing 3', respectively. However, to the contrary, it is also possible to provide the cam grooves 21 on the second connector housing 3' and to provide the cam pins 36 on the lever 2', respectively. In this way, design freedom is enhanced. Furthermore, according to the first and the second embodiments, the levers 2 and 2' are provided on the first connector housings 1 and 1' in a rotatable and linearly movable manner, and the levers 2 and 2' are arranged to move from the rotation initial position (a movement initial position) to the fitting completive position by the rotational movements and the linear movements (the sliding movements). However, the present invention is also applicable to a case where the lever 2 or 2' is arranged to move from the movement initial position to the fitting completive position only by the rotational movement, or a case where the lever 2 or 2' is arranged to move from the movement initial position to the fitting completive position only by the linear movement (the sliding movement), as those observed in the related examples.

What is claimed is:

1. A lever fitting-type manual disconnector comprising:

a first connector housing having a first terminal;

a second connector housing having a second terminal for being combined with the first connector housing;

a lever provided on the first connector housing;

a cam groove provided on the lever;

a cam pin provided on the second connector housing for being engaged with the cam groove; and a fitting-state detective switch for detecting a fitting state of the connector housings, wherein the lever is rotated in a state where the cam pin is engaged with the cam groove to establish a rotation completive position, in which the terminals on the both connector housings contact to each other, the lever is moved linearly from the foregoing position to establish a fitting completive position, in which the fitting-state detective switch is turned on, the lever is moved linearly from the fitting completive position reverse to the foregoing linear direction to establish the rotation completive position, in which the fitting-state detective switch is turned off, the lever is rotated reverse to the foregoing rotational direction to establish an unconnected state of the terminals by detaching the both connector housings, and a circuit to be turned on and off by the fitting-state detective switch and a power switch composed of the respective terminals on the both connector housings are interposed in a power circuit in series connection.

2. The lever fitting-type manual disconnector according to claim 1, wherein the lever located in the fitting completive position is designed as linearly movable by using only one finger.

3. The lever fitting-type manual disconnector according to claim 1, wherein the cam groove is provided on the lever, and the cam pin is provided on the second connector housing.

4. The lever fitting-type manual disconnector according to claim 1, wherein any one of the first connector housing and the lever is arranged to be placed in a position to inhibit fitting of a tool to fixing means for fixing the second connector housing when the first connector housing is fitted to the second connector housing and the terminals of the both connector housings are set to a connected state.

5. The lever fitting-type manual disconnector according to claim 4, wherein the fixing means is a bolt, and any one of the first connector housing and the lever is arranged to be placed in a position immediately above the bolt when the first connector housing is fitted to the second connector housing and the terminals of the both connector housings are set to the connected state.

6. A lever fitting-type manual disconnector comprising:

a first connector housing having a first terminal;

a second connector housing having a second terminal for being combined with the first connector housing;

a lever provided on the first connector housing;

a cam groove provided on the lever;

a cam pin provided on the second connector housing for being engaged with the cam groove; and a fitting-state detective switch for detecting a fitting state of the connector housings, wherein movements of the lever includes a rotational movement between a rotation initial position and a rotation completive position where the terminals on the both connector housings are connected and unconnected, and a linear movement between the rotation completive position and a fitting completive position where a fitting-state detective switch is turned on and off, and a circuit to be turned on and off by the fitting-state detective switch and a power switch composed of the respective terminals on the both connector housings are interposed in a power circuit in series connection.

* * * * *

UNITED STATES PATENT AND TRADEMARK OFFICE

CERTIFICATE OF CORRECTION

PATENT NO. : 6,619,970 B2
APPLICATION NO. : 10/247507
DATED : September 16, 2003
INVENTOR(S) : Hurotaka Fukushima et al.

It is certified that error appears in the above-identified patent and that said Letters Patent is hereby corrected as shown below:

On the title page, item (73), after first assignee, insert
--Toyota Jidosha Kabushiki Kaisha, Aichi, Japan--.

Signed and Sealed this
Twenty-first Day of February, 2012

David J. Kappos

David J. Kappos
*Director of the United States Patent and Trademark Office*